US006329129B1

(12) United States Patent
Yamazaki

(10) Patent No.: US 6,329,129 B1
(45) Date of Patent: Dec. 11, 2001

(54) HEAT-DEVELOPABLE COLOR LIGHT-SENSITIVE MATERIAL

(75) Inventor: Takayasu Yamazaki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/717,009

(22) Filed: Nov. 22, 2000

(30) Foreign Application Priority Data

Nov. 25, 1999 (JP) ..... 11-334895

(51) Int. Cl.[7] ..... G03C 8/40; G03C 8/10; G03C 8/22; G03C 8/36; G03C 8/52

(52) U.S. Cl. ..... 430/523; 430/203; 430/214; 430/216; 430/218; 430/219; 430/551; 430/559

(58) Field of Search ..... 430/203, 214, 430/216, 218, 219, 523, 559, 551

(56) References Cited

U.S. PATENT DOCUMENTS 5,026,634 * 6/1991 Ono et al. ..... 430/216
5,236,803 * 8/1993 Ono et al. ..... 430/218
6,177,227 * 1/2001 Nakagawa ..... 430/218

FOREIGN PATENT DOCUMENTS 5127335 5/1993 (JP) .
720620 1/1995 (JP) .

* cited by examiner

*Primary Examiner*—Richard L. Schilling
(74) *Attorney, Agent, or Firm*—Birch, Stewart, Kolasch & Birch, LLP

(57) ABSTRACT

A heat-developable color light-sensitive material comprising a support having thereon at least a light-sensitive silver halide emulsion, a hydrophilic binder and a dye-donating compound capable of releasing a diffusible dye in correspondence or counter-correspondence to the silver development, wherein at least two light-insensitive layers are provided between the support and a light-sensitive layer closest to the support and the light-insensitive layer not adjacent to the light-sensitive layer contains at least one compound represented by the following formula (I) or (II):

(I)

wherein $R^1$ to $R^6$ are defined herein (II)

wherein $R^7$, $R^8$ and $R^9$ are defined herein and Y represents —CO— or —$SO_2$—.

6 Claims, No Drawings

HEAT-DEVELOPABLE COLOR LIGHT-SENSITIVE MATERIAL

FIELD OF THE INVENTION

The present invention relates to a heat-developable color light-sensitive material capable of giving a diffusion transfer image reduced in the uneven density of image and favored with excellent discrimination.

BACKGROUND OF THE INVENTION

A heat-developable color light-sensitive material is known in the art. The heat-developable light-sensitive material and process therefor are described, for example, in *Shashin Kogaku no Kiso* (*Principle of Photographic Engineering*), *Edition of Non-Silver Salt System Photography,* Corona Co., pp. 242–255 (1982), and U.S. Pat. No. 4,500,626.

Furthermore, a method of forming a dye image by the coupling reaction of an oxidation product of a developing agent with a coupler is described in U.S. Pat. Nos. 3,761,270 and 4,021,240. Also, a method of forming a positive color image by the bleaching of a photosensitive silver dye is described in U.S. Pat. No. 4,235,957.

A method of releasing or forming imagewise a diffusible dye by a heat development and then transferring the diffusible dye to a dye-fixing image-receiving material has already been put into practice. In this method, both a negative dye image and a positive dye image can be obtained by varying the kind of the dye-donating compound used or the kind of the silver halide used. More specifically, this method is described in U.S. Pat. Nos. 4,500,626, 4,483,914, 4,503,137 and 4,559,290, JP-A-58-149046 (the term "JP-A" as used herein means an "unexamined published Japanese patent application"), JP-A-60-133449, JP-A-59-218443, JP-A-61-238056, EP-A-220746, JIII Journal of Technical Disclosure 87-6199 and EP-A-210660.

For obtaining a positive color image by a heat development, a large number of methods have been proposed. For example, U.S. Pat. No. 4,559,290 discloses a method of allowing a reducing agent or a precursor thereof to be present together with an oxidized DRR compound having no capability of releasing a dye image, oxidizing the reducing agent according to the amount of silver halide exposed by a heat development, and reducing the oxidized DDR compound with a reducing agent remaining unoxidized to release a non-diffusible dye. Furthermore, EP-A-220746 and JIII Journal of Technical Disclosure 87-6199 (Vol. 12, No. 22) disclose a heat-developable color light-sensitive material using a compound which releases a diffusible dye by the reductive cleavage of N—X bond (wherein X represents oxygen atom, nitrogen atom or sulfur atom) in the same mechanism as described above.

In these heat-developable light-sensitive materials, the matter of importance is how much the fogging can be suppressed at the heat development. Particularly, in the heat-developable light-sensitive material using a reductive dye-donating compound, the dye is released at the development, for example, by the oxidation reaction of the dissolved oxygen in the light-sensitive material and even when not exposed, the fogging disadvantageously increases.

In order to prevent this unnecessary oxygen oxidation, a method of adding a reducing agent to a light-sensitive material is described in JP-A-60-198540, JP-A-62-85241 and JP-A-62-201434. However, if such a compound is simply added to a layer containing light-sensitive silver halide, the silver halide is reduced to release a dye and the fog increases. Of course, even if the reducing agent is added to a layer adjacent to a light-sensitive layer, the fog is similarly some or less increased.

To solve this problem, a technique of adding a reducing agent to a layer in the outer side of a light-sensitive material farthest from the support and not adjacent to a light-sensitive layer is described in JP-A-5-127335 and JP-A-7-20620. This addition technique has a very high effect for preventing the increase of fogging, however, in the method described in JP-A-5-127335, it has been found that a certain particular smoke-like uneven density of image (unevenness like a black-and-white Japanese ink drawing very low in the density) is generated. Also, the technique described in JP-A-7-20620 where a countermeasure for the uneven density of image is taken account of has a problem that another uneven density of image is newly generated.

SUMMARY OF THE INVENTION

The object of the present invention is to provide a color light-sensitive material capable of giving a diffusion transfer image free of uneven density of image and reduced in the fog.

The above-described object has been attained by the following inventions (1) to (3).

(1) A heat-developable color light-sensitive material having a multi-layer structure, comprising a support having thereon at least a light-sensitive silver halide emulsion, a hydrophilic binder and a dye-donating compound capable of releasing a diffusible dye in correspondence or counter-correspondence to the silver development, wherein at least two light-insensitive layers are provided between the support and a light-sensitive layer closest to the support and the light-insensitive layer not adjacent to the light-sensitive layer contains at least one compound represented by the following formula (I) or (II):

(I)

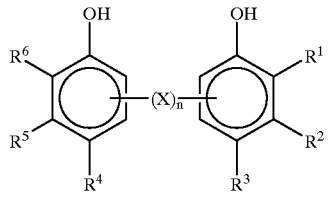

wherein $R^1$ to $R^6$ each represents hydrogen atom, a halogen atom, a hydroxyl group, a cyano group, a sulfo group, a carboxyl group, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted sulfonyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group, provided that at least one of $R^1$ and $R^3$ and at least one of $R^4$ and $R^6$ represent a hydroxyl group and that $R^1$ and $R^2$, $R^2$ and $R^3$, $R^4$ and $R^5$, or $R^5$ and $R^6$ may be combined with each other to form a ring, X represents a divalent linking group, and n represents 1 or 0;

(II)

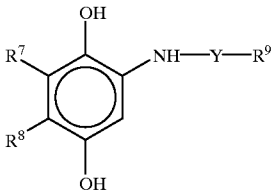

wherein $R^7$ and $R^8$ each represents hydrogen atom, a halogen atom, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group, provided that $R^7$ and $R^8$ may combine with each other to form a ring, Y represents —CO— or —$SO_2$—, and $R^9$ represents a substituted or unsubstituted alkyl group, a substituted or unsubstituted aryl group, a substituted or unsubstituted heterocyclic group, a substituted or unsubstituted alkoxy group, a substituted or unsubstituted aryloxy group or a substituted or unsubstituted amino group.

(2) The heat-developable color light-sensitive material as described in (1) , which is scan-exposed at an exposure time of $1\times10^{-5}$ seconds or lower per one picture element.

(3) The heat-developable color light-sensitive material as described in (1) or (2), wherein at least one light-sensitive layer has a sensitivity maximum wavelength in the infrared wavelength region of 750 nm or more.

DETAILED DESCRIPTION OF THE INVENTION

The specific construction of the present invention is described in detail below.

The compound represented by formula (I) or (II) for use in the present invention is a so-called hydroquinone derivative known in the field of photography. For example, the compound represented by formula (I) is disclosed as a reducing agent used in combination with a dye-donating compound to be reduced in JP-A-2-32338. In formula (I), $R^1$ to $R^2$ each represents hydrogen atom, a halogen atom, a hydroxyl group, a cyano group, a sulfo group, a carboxyl group, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted sulfonyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group (including an arylcarbonyloxy group). Specific examples thereof include those described in JP-A-2-32338, supra, pp. 2–3. At least one of $R^1$ and $R^3$ and at least one of $R^4$ and $R^6$ represent a hydroxyl group. $R^1$ and $R^2$, $R^2$ and $R^3$, $R^4$ and $R^5$, or $R^5$ and $R^6$ may be combined with each other to form a ring. X represents a divalent linking group, and n represents 1 or 0.

The compound represented by formula (II) is disclosed as a reducing agent having a function as a color mixing inhibitor in JP-A-2-64633. In formula (II), $R^7$ and $R^8$ each represents hydrogen atom, a halogen atom, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group (including an arylcarbonyloxy group), and $R^7$ and $R^8$ may combine with each other to form a ring. Y represents —CO— or —$SO_2$—. $R^9$ represents a substituted or unsubstituted alkyl group, a substituted or unsubstituted aryl group, a substituted or unsubstituted heterocyclic group, a substituted or unsubstituted alkoxy group, a substituted or unsubstituted aryloxy group or a substituted or unsubstituted amino group. Specific examples of these groups include those described in detail in JP-A-2-64633, page 3.

The compound represented by formula (I) or (II) for use in the present invention is preferably inhibited from moving between the coating layers both at the coating time and at the development time. In this meaning, the compound is preferably ballasted by a long-chain alkyl group. In particular, it is effective that the compound has high organic property where the I/O value is 1.5 or less, more preferably 1 or less. This I/O value is a concept described in detail in Yoshio Koda, *Yuki Gainen Zu* (*Organic Concept Diagram*), Sankyo Shuppan, and this value is often used as an index for showing the organic or inorganic property of an organic compound also in the field of photography. As the compound represented by formula (I) or (II) having such an I/O value, the compounds described in JP-A-5-127335 may be used. However, the compound which can be used in the present invention is not limited to those having an I/O value in the above-described range and other compounds may also be used as long as it is a compound having substantially no effect on the light-sensitive layer.

In the present invention, the compound represented by formula (I) or (II) is added to a layer which is a light-insensitive layer positioned closer to the support than the light-sensitive layer closest to the support in the light-sensitive layer and which is the light-insensitive layer not adjacent to the light-sensitive layer. The light-insensitive layer must comprise at least two layers for providing the construction of the present invention but may of course comprise three or more layers. In a diffusion transfer-type light-sensitive material like the present invention, the maximum density generally decreases as the number of layers in the light-insensitive layer increases, therefore, the number of layers is preferably selected not to cause the reduction of the maximum density.

The amount of the compound represented by formula (I) or (II) added may be selected from a wide range but the amount added is preferably from $10^{-6}$ to $10^{-1}$ mol/m$^2$, more preferably from $10^{-5}$ to $10^{-2}$ mol/m$^2$. These compounds may be used in combination of two or more thereof and also in this combination use, the amount added is preferably in the above-described range. Specific examples of the compounds for use in the present invention are set forth below, however, the present invention is not limited thereto.

R-1

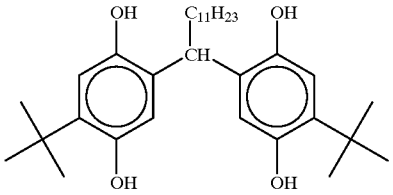

R-2

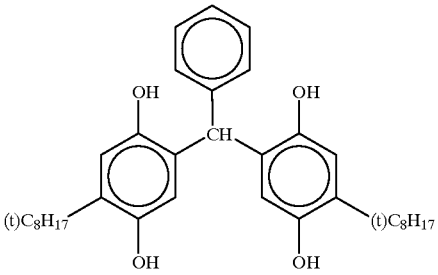

R-3

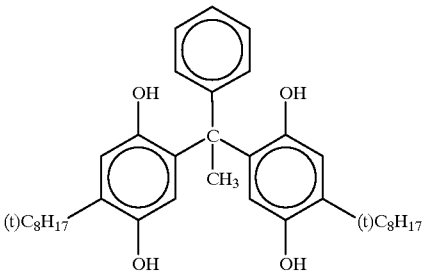

R-4

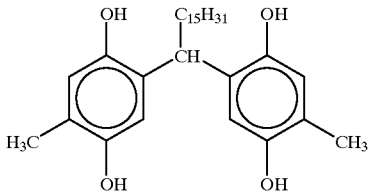

R-5

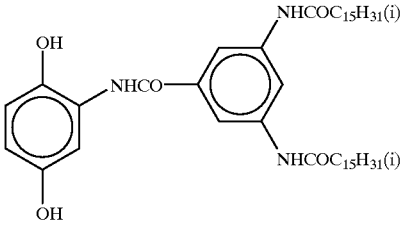

-continued

R-6

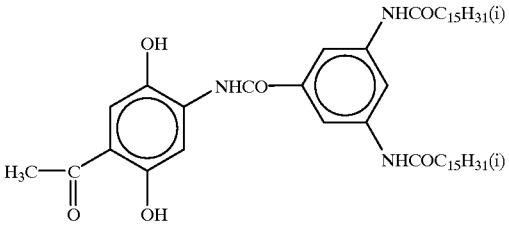

R-7

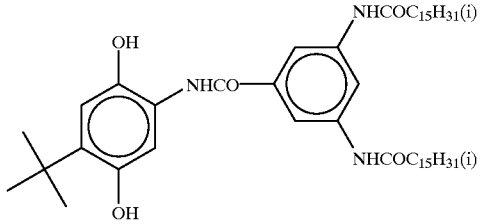

R-8

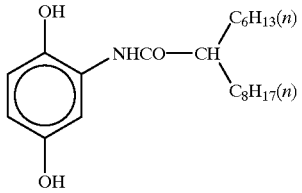

R-9

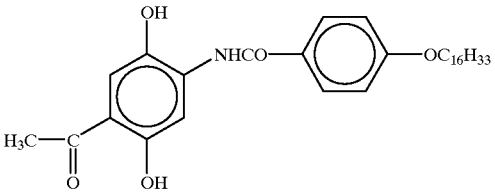

R-10

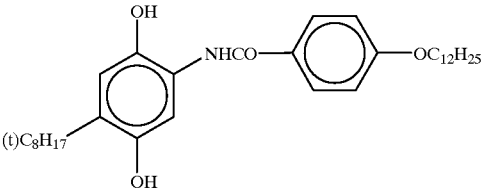

R-11

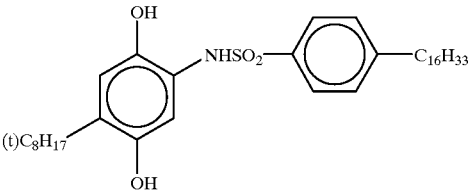

R-12

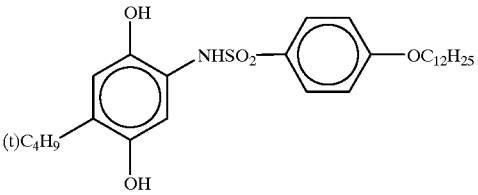

-continued

R-13

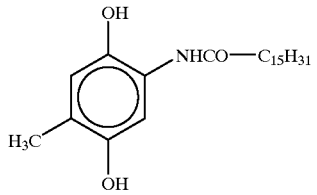

R-14

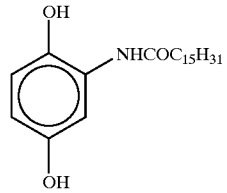

R-15

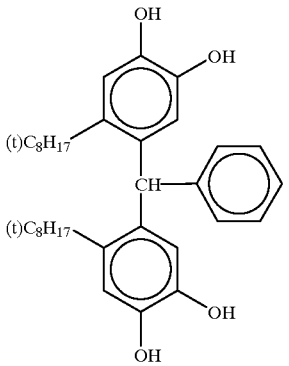

R-16

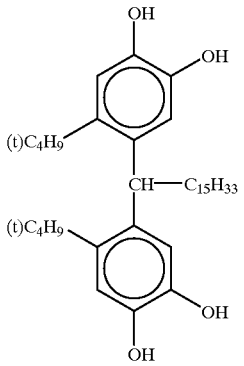

The light-sensitive material of the present invention fundamentally comprises, in addition to the above-described compound, a light-sensitive silver halide, a hydrophilic binder and a dye-donating compound capable of releasing a diffusible dye according to silver development on a support. If desired, an organic metal salt oxidizing agent and the like may be added. These components are added to the same layer in many cases but may be separately added to different layers as long as these are in the state of being reactive with each other.

In the heat-developable light-sensitive material of the present invention, other than those described above may be constructed in accordance with conventional techniques.

In order to obtain a wide range of colors in the chromaticity diagram using three primary colors of yellow, magenta and cyan, at least three silver halide emulsion layers having light-sensitivity in different spectral ranges are used in combination. In the present invention, a combination of a blue-sensitive layer, a green-sensitive layer and a red-sensitive layer may be used. These light-sensitive layers may be arranged in various orders known in the field of normal color light-sensitive materials and, if desired, each light-sensitive layer may be divided into two or more layers.

In particular, according to a color image forming method by the commonly used subtractive color process, a silver halide emulsion having spectral sensitivity in the wavelength region of 400 to 500 nm (blue-sensitive emulsion) is incorporated into the light-sensitive layer containing a yellow dye-donating compound (dye image-forming material), a silver halide emulsion spectrally sensitized to 500 to 600 nm (green-sensitive emulsion) is incorporated into the light-sensitive layer containing a magenta dye-donating compound (dye image-forming material), and a silver halide emulsion spectrally sensitized to 600 to 740 nm (red-sensitive emulsion) is incorporated into the light-sensitive layer containing a cyan dye-donating compound (dye image-forming material). In this case, the yellow light-sensitive layer is colored yellow, therefore, this layer is preferably provided as an uppermost light-sensitive layer distant from the support.

Namely, in this combination, a cyan dye-donating compound-containing red-sensitive layer, an interlayer, a magenta dye-donating compound-containing green-sensitive layer, an interlayer, a yellow dye-donating compound-containing blue-sensitive layer, an interlayer and a protective layer are provided in this order on the support.

Even when the cyan layer and the magenta layer is reversed, almost the same properties can be obtained. Each light-sensitive layer may comprise two layers and each layer may contain a dye-donating compound and a silver halide emulsion or in order to attain high sensitivity, a silver halide emulsion may be incorporated only into the upper layer while incorporating a dye-donating compound also into the lower layer. A light-sensitive material where at least one visible light-sensitive layer is displaced by an infrared ray-sensitive layer having a spectral sensitivity maximum in the wavelength region of 750 nm or more is also preferably used.

In the heat-developable light-sensitive layer, various auxiliary layers may be provided, such as protective layer, undercoat layer, interlayer, yellow filter layer, antihalation layer and back layer. In the case where the support is a polyethylene laminated paper containing a white pigment such as titanium oxide, the back layer is preferably designed to have an antistatic function and a surface resistivity of $10^{12}$ Ω·cm or less.

The silver halide emulsion for use in the heat-developable color light-sensitive material of the present invention is described in detail below.

The silver halide for use in the present invention may be any of silver chloride, silver bromide, silver iodobromide, silver chlorobromide, silver chloroiodide and silver chloroiodobromide. The silver halide emulsion may be a surface latent image-type emulsion or an internal latent image-type emulsion. The internal latent image-type emulsion is used as a direct reversal emulsion by combining it with a nucleating agent or a light fogging agent. The silver halide emulsion may be a so-called core-shell emulsion where the phase in the inside of the grain differs from that in the grain surface layer, or an emulsion where silver halides different in the composition may be joined by an epitaxial junction. The silver halide emulsion may be monodisperse or polydisperse, and a method of mixing monodisperse emulsions to control the gradation described in JP-A-1-167743 and JP-A-4-223463 is preferably used. The grain size is preferably from 0.1 to 2 μm, more preferably from 0.2 to 1.5 μm. The silver halide grain may have any crystal habit, for example, a regular crystal system such as cubic form, octahedral form or tetradecahedral form, an irregular crystal system such as spherical form or tabular form having a high aspect ratio, a crystal system having a crystal defect such as twin plane, or a composite system thereof.

Specifically, silver halide emulsions prepared by the method described in U.S. Pat. No. 4,500,626, col. 50, and U.S. Pat. No. 4,628,021, *Research Disclosure* (hereinafter simply referred to as RD) Nos. 17029 (1978), 17643 (December, 1978), pp. 22–23, 18716 (November, 1979), page 648, and 307105 (November, 1989), pp. 863–865, JP-A-62-253159, JP-A-64-13546, JP-A-2-236546, JP-A-3-110555, P. Glafkides, *Chemie et Phisique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964), all may be used.

In the light-sensitive material of the present invention, an organic metal salt may be used as an oxidizing agent in combination with the light-sensitive silver halide. Among the organic metal salts, organic silver salts are particularly preferred. Examples of the organic compound which can be used in forming the organic silver salt oxidizing agent include benzotriazoles, fatty acids and other compounds described in U.S. Pat. No. 4,500,626, col. 52–53. Also, silver salts of a carboxylic acid having an alkenyl group, such as silver phenyl-propionate described in JP-A-60-113235, and silver acetylide described in JP-A-61-249044 are useful. The organic silver salts may be used in combination of two or more thereof. The organic silver salt may be used in combination in an amount of 0.01 to 10 mol, preferably from 0.01 to 1 mol, per mol of the light-sensitive silver halide. The total coated amount of the light-sensitive silver halide and the organic silver salt is suitably from 50 mg/m$^2$ to 10 g/m$^2$ in terms of silver.

In the light-sensitive material of the present invention, various antifoggants and photographic stabilizers may be used. Examples thereof include azoles and azaindenes described in RD 17643, pp. 24–25 (1978), nitrogen-containing carboxylic acids and phosphoric acids described in JP-A-59-168442, mercapto compounds and metal salts thereof described in JP-A-59-111636, and acetylene compounds described in JP-A-62-87957.

Examples of the reducing agent for use in the present invention include those known in the field of light-sensitive material. A dye-donating compound having reducing property, which is described later, can also be used (in this case, other reducing agents may be used in combination). Furthermore, a reducing agent precursor which has no reducing property by itself but exhibits a reducing property under the action of a nucleophilic reagent or heat during development may be used.

Examples of reducing agent for use in the light-sensitive material of the present invention include reducing agents and reducing agent precursors described in U.S. Pat. No. 4,500,626 (col. 49–50), U.S. Pat. No. 4,483,914 (col. 30–31), U.S. Pat. No. 4,330,617 and 4,590,152, JP-A-60-140335 (pp. 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, and EP-A-220746 (pp. 78–96). A combination of various reducing agents disclosed in U.S. Pat. No. 3,039,869 may also be used.

In the case of using a non-diffusible reducing agent, an electron transfer agent and/or an electron transfer agent precursor can be used in combination, if desired, so as to accelerate the electron transfer between the non-diffusible reducing agent and the developable silver halide. The electron transfer agent or precursor thereof can be selected from the above-described reducing agents or precursors thereof. The electron transfer agent or precursor thereof is preferably greater in the mobility than the non-diffusible reducing agent (electron donor). Particularly, 1-phenyl-3-pyrazolidones and aminophenols are useful as the electron transfer agent.

The non-diffusible reducing agent (electron donor) used in combination with the electron transfer agent may be sufficient if it does not substantially move in the layers of the light-sensitive material and may be selected from the above-described reducing agents, if it meets the above condition of the substantial non-mobility. Preferred examples thereof include hydroquinones, sulfonamidophenols, sulfonamidonaphthols, compounds described as the electron donor in JP-A-53-110827, and non-diffusible and reducing dye-donating compounds described later. In the present invention, the amount of the reducing agent added is preferably from 0.001 to 20 mol, more preferably from 0.01 to 10 mol, per mol of silver.

In the light-sensitive material of the present invention, a compound which forms or releases a known dye (e.g., pigment, dye) or diffusible dye, as a dye image-forming material is used. For forming a dye image, a non-diffusible dye-donating compound is incorporated, for example, into the light-sensitive material, a diffusible dye is released in correspondence or counter-correspondence to the reaction of reducing silver ion (silver halide) to silver, and the diffusible dye is transferred to a mordant sheet.

Examples of the dye-donating compound which can be used in the light-sensitive material of the present invention include compounds (couplers) capable of forming a dye upon an oxidative coupling reaction. This coupler may be either two-equivalent or four-equivalent. Furthermore, the non-diffusible group may form a polymer chain. Specific examples of the color developing agent and the coupler are described in detail in T. H. James, *The Theory of the Photographic Process,* 4th ed. pp. 291–334 and pp. 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Another example of the dye-donating compound which can be used is a non-diffusible and dye-donating compound (thiazolidine-type compound) having a heterocyclic ring containing a nitrogen atom and a sulfur atom or a selenium atom, which causes a cleaving reaction of the heterocyclic ring in the presence of silver ion or a soluble silver complex to release a diffusible dye described in JP-A-59-180548.

Still another example of the dye-donating compound is a compound having a function of imagewise releasing or diffusing a diffusible dye. This type of compound can be represented by the following formula (LI):

$$(\text{Dye-Y'})_n\text{—Z} \qquad \text{(LI)}$$

wherein Dye represents a dye group or a dye group or dye precursor group temporarily shifted to a short wavelength, Y"represents a mere bond or a linking group, Z represents a group having a property of causing a difference in the diffusibility of the compound represented by $(Dye\text{-}Y')_n$—Z in correspondence or counter-correspondence to the light-sensitive silver salt having an imagewise latent image or releasing the Dye and causing a difference in the diffusibility between the released Dye and the $(Dye\text{-}Y')_n$—Z, n represents an integer of 1 or 2, and when n is 2, two Dye-Y' moieties may be the same or different.

Specific examples of the dye-donating compound represented by formula (LI) include the following compounds (1) to (5). The compounds (1) to (3) release a diffusible dye in counter-correspondence to the development of silver halide and the compounds (4) and (5) release a diffusible dye image in correspondence to the development of silver halide.

(1) Dye developing agents in which a hydroquinone-type developing agent and a dye component are connected, described in U.S. Pat. Nos. 3,134,764, 3,362,819, 3,597,200, 3,544,545 and 3,482,972 can be used. These dye developing agents are diffusible under alkaline conditions but become non-diffusible upon reaction with silver halide.

(2) Non-diffusible compounds which release a diffusible dye under alkaline conditions but lose the function thereof upon reaction with silver halide, described in U.S. Pat. No. 4,503,137 can also be used. Examples thereof include compounds which release a diffusible dye by an intramolecular nucleophilic substitution reaction described in U.S. Pat. No. 3,980,479, and compounds which release a diffusible dye by an intramolecular rearrangement reaction of isooxazolone ring described in U.S. Pat. No. 4,199,354.

(3) Non-diffusible compounds which react with a reducing agent remaining unoxidized by the development and release a diffusible dye, described in U.S. Pat. No. 4,559,290, EP-A-220746, U.S. Pat. No. 4,783,396, and JIII Journal of Technical Disclosure 87-6199 can also be used Examples thereof include compounds which release a diffusible dye by an intramolecular nucleophilic substitution reaction after the reduction described in U.S. Pat. Nos. 4,139,389 and 4,139,379, JP-A-59-185333 and JP-A-57-84453, compounds which release a diffusible dye by an intramolecular electron transfer reaction after the reduction described in U.S. Pat. No. 4,232,107, JP-A-59-101649, JP-A-61-88257 and RD No. 24025 (1984), compounds which release a diffusible dye resulting from cleavage of a single bond after the reduction described in West German Patent 3,008,588A, JP-A-56-142530, and U.S. Pat. Nos. 4,343,893 and 4,619,884, nitro compounds which release a diffusible dye after receiving electrons described in U.S. Pat. No. 4,450,223, and compounds which release a diffusible dye after receiving electrons described in U.S. Pat. No. 4,609,610.

Among these, preferred are compounds having an N—X bond (wherein X represents oxygen, sulfur or nitrogen atom) and an electron-withdrawing group within one molecule described in EP-A-220746, JIII Journal of Technical Disclosure 87-6199, U.S. Pat. No. 4,783,396, JP-A-63-201653 and JP-A-63-201654, compounds having an $SO_2$—X bond (wherein X has the same meaning as defined above) and an electron-withdrawing group within one molecule described in JP-A-1-26842, compounds having a PO—X bond (wherein X has the same meaning as defined above) and an electron-withdrawing group within one molecule described in JP-A-63-271344, and compounds having a C—X' bond (wherein X' has the same meaning as X or represents —$SO_2$—) and an electron-withdrawing group within one molecule described in JP-A-63-271341. In addition, compounds which release a diffusible dye resulting from the cleavage of a single bond after the reduction by the π bond conjugated with an electron-acceptong group described in JP-A-1-161237 and JP-A-1-161342 may also be used.

Among these, more preferred are compounds having an N—X bond and an electron-withdrawing group within one molecule. Specific examples thereof include Compounds (1) to (3), (7) to (10), (12), (13), (15), (23) to (26), (31), (32), (35), (36), (40), (41), (44), (53) to (59), (64) and (70) described in EP-A-220746 or U.S. Pat. No. 4,783,396, and Compounds (11) to (23) described in JIII Journal of Technical Disclosure 87-6199.

(4) Compounds (DDR couplers) which are a coupler having a diffusible dye as the splitting-off group and which release a diffusible dye by the reaction with an oxidation product of a reducing agent can be used. Specific examples thereof include those described in British Patent 1,330,524, JP-B-48-39165 (the term "JP-B" as used herein means an "examined Japanese patent publication"), and U.S. Pat. Nos. 3,443,940, 4,474,867 and 4,483,914.

(5) Compounds (DRR compounds) which are reductive to silver halide or an organic silver salt and release a diffusible dye after reducing the silver halide or an organic silver salt, can be used. These compounds are preferred because other reducing agent needs not be used and therefore, the problem of causing staining of the image due to an oxidative decomposition product of the reducing agent can be eliminated. Representative examples thereof include those described in U.S. Pat. Nos. 3,928,312, 4,053,312, 4,055,428 and 4,336,322, JP-A-59-65839, JP-A-59-69839, JP-A-53-3819, JP-A-51-104343, RD No. 17465, U.S. Pat. Nos. 3,725,062, 3,728,113 and 3,443,939, JP-A-58-116537, JP-A-57-179840 and U.S. Pat. No. 4,500,626. Specific examples of the DRR compound include the compounds described in U.S. Pat. No. 4,500,626 (col. 22–44). Among these, preferred are Compounds (1) to (3), (10) to (13), (16) to (19), (28) to (30), (33) to (35), (38) to (40), and (42) to (64) disclosed in U.S. Pat. No. 4,500,626. Also, compounds described in U.S. Pat. No. 4,639,408 (col. 37–39) are useful.

In addition, a dye-donating compound other than the compound represented by formula (LI) and the coupler described above can used and examples thereof include dye silver compounds in which an organic silver salt and a dye are connected (see, *Research Disclosure,* May 1978, pp. 54–58), azo dyes for use in the heat developable silver dye bleaching process (see, U.S. Pat. No. 4,235,957, *Research Disclosure,* April 1976, pp. 30–32), and leuco dyes (see, U.S. Pat. Nos. 3,985,565 and 4,022,617). In the present invention, the above-described DRR compounds are particularly preferred.

The hydrophobic additives such as a dye-donating compound and a non-diffusible reducing agent can be incorporated in the layer of a light-sensitive element by a known method described, for example, in U.S. Pat. No. 2,322,027. In this case, a high boiling point organic solvent described in JP-A-59-83154, JP-A-59-178451, JP-A-59-178452, JP-A-59-178453, JP-A-59-178454, JP-A-59-178455 and JP-A-59-178457 may be used in combination with a low boiling point organic solvent having a boiling point of 50 to 160° C., if desired.

The amount of the high boiling point organic solvent is 10 g or less, preferably 5 g or less, per g of the dye-donating compound used, or 1 ml or less, preferably 0.5 ml or less, more preferably 0.3 ml or less, per g of the binder used. A dispersion process using a polymer described in JP-B-51-39853 and JP-A-51-59943 may also be used. In the case of substantially insoluble in water, a method of finely dispersing the compound in the binder may be used other than the above-described methods.

In dispersing a hydrophobic compound in a hydrophilic colloid as a binder, various surfactants may be used. For example, those described as the surface active agent in JP-A-59-157636 (pp. 37–38) and *Research Disclosures* described later may be used. Furthermore, phosphoric acid ester-type surface active agents described in JP-A-7-56267, JP-A-7-228589 and West German Patent Publication (OLS) No. 1932299 may also be used.

In the light-sensitive material of the present invention, a compound which activates the development and at the same time, stabilizes an image may be used. Specific examples of compounds which are preferably used include those described in U.S. Pat. No. 4,500,626 (col. 51–52).

In the present invention, the dye-fixing material for use in the processing of the light-sensitive material may be separately coated on a support different from that for the light-sensitive material or may be coated on the same support as the light-sensitive material. With respect to the relationship of the light-sensitive material with the dye-fixing material, the relationship with the support and the relationship with the white reflective layer, those described in U.S. Pat. No. 4,500,626 (col. 57) can also apply for the present invention. As such, the form of coating the light-sensitive material and the dye-fixing material on the same support is included in the present invention and for the convenience sake, the light-sensitive material is sometimes described using the term "light-sensitive element" or "photographic element", and the dye-fixing material is sometimes described using the term "image-receiving element" or "dye-fixing element.

The dye-fixing material which is preferably used in the present invention comprises at least one layer containing a mordant and a binder. The mordant used may be a mordant known in the photographic field. Specific examples thereof include mordants described in U.S. Pat. No. 4,500,626 (col. 58–59) and JP-A-61-88256 (pp. 32–41), and those described in JP-A-62-244043 and JP-A-62-244036. Furthermore, dye-accepting polymer compounds described in U.S. Pat. No. 4,463,079 may also be used. If desired, the dye-fixing material may comprise auxiliary layers such as protective layer, release layer and anti-curling layer. In particular, it is advantageous to provide a protective layer.

The binder for the constituent layers of the light-sensitive element of the dye-fixing material is preferably a hydrophilic binder. Examples thereof include those described in JP-A-62-253159, pp. 26–28. Specifically, a transparent or semi-transparent hydrophilic binder is preferred and examples thereof include proteins such as gelatin and gelatin derivatives, natural compounds such as cellulose derivatives, starch, gum arabi, dextran, pullulan and other polysaccharides, and synthetic polymer compounds such as polyvinyl alcohol, polyvinyl pyrrolidone and acrylamide polymer. In addition, highly water absorbing polymers described in JP-A-62-245260, more specifically, homopolymers of a vinyl monomer having —COOM or —$SO_3M$ (wherein M is a hydrogen atom or an alkaline metal atom), copolymers of these vinyl monomers, and copolymers of this vinyl monomer with another vinyl monomer (for example, sodium methacrylate, ammonium methacrylate and Sumikagel L-5H produced by Sumitomo Chemical Co., Ltd.) may also be used. These binders may be used in combination of two or more thereof.

In the case of performing the heat development while supplying a slight amount of water, the water absorption can be expedited by using the above-described highly water absorbing polymer. Furthermore, when the highly water absorbing polymer is used in the mordant layer or a protective layer therefor, the dye transferred can be prevented from re-transferring to other elements from the mordant element.

Known photographic additives which can be used in the heat-developable light-sensitive material or the dye-fixing material are described in RD, Nos. 17643, 18716 and 307105, supra, and the pertinent portions thereof are summarized in the following table.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col. to p. 649, right col. | pp. 866–868 |
| 4. Brightening agent | p. 24 | p. 647, right col. | p. 868 |
| 5. Antifoggant, stabilizer | p. 24–25 | p. 649, right col. | pp. 868–870 |
| 6. Light absorbent, filter dye, UV absorbent | pp. 25–26 | p. 649, right col. to p. 650, left col. | p. 873 |
| 7. Dye image stabilizer | p. 25 | p. 650, left col. | p. 872 |
| 8. Hardening agent | p. 26 | p. 651, left col. | p. 874–875 |
| 9. Binder | p. 26 | p. 651, left col. | pp. 873–874 |
| 10. Plasticizer, lubricant | p. 27 | p. 650, right col. | p. 876 |
| 11. Coating aid, surfactant | pp. 26–27 | p. 650, right col. | pp. 875–876 |
| 12. Antistatic agent | p. 27 | p. 650, right col. | pp. 876–877 |
| 13. Matting agent | | | pp. 878–879 |

In the present invention, the support for the light-sensitive material or the dye-fixing material is preferably a photographic support such as paper and synthetic polymer (film) described in *Shashin Kogaku no Kiso -Ginen Shashin hen-* (*Base of Photographic Engineering -Silver Salt Photography-*), compiled by Nippon Shashin Gakkai, issued by Corona Sha, pp. 223–240 (1979). Specific examples thereof include polyethylene terephthalate, polyethylene naphthalate, polycarbonate, polyvinyl chloride, polystyrene, polypropylene, polyimide, cellulose (e.g., triacetyl cellulose), support materials obtained by incorporating a pigment such as titanium oxide into these films, synthetic paper obtained from polypropylene by film process, mixed paper obtained from a synthetic resin pulp such as polyethylene and a natural pulp, Yankee paper, baryta paper, coated paper (particularly cast coat paper), metal, cloths, glasses, and ceramics. These support materials may be used individually or may be formed into a support having laminated on one surface or both surfaces thereof a synthetic polymer such as polyethylene, PET, polyester or polystyrene.

Other than these, supports described in JP-A-62-253159 (pp. 29–31), JP-A-1-161236 (pp. 14–17), JP-A-63-316848, JP-A-2-22651, JP-A-3-56955 and U.S. Pat. No. 5,001,033 may be used.

On the surface of the support, a hydrophilic binder, an oxide of a semiconducting metal such as alumina sol and tin oxide, carbon black, and other antistatic agents may be coated. Furthermore, for the purpose of improving the wettability of the coating solution or the adhesion between the coated film and the support, gelatin or a polymer such as PVA is preferably coated on the support surface in advance.

The thickness of the support varies depending on the end use but usually from 40 to 400 $\mu$m. However, in the case of forming an image using elements separately coated on two or more different supports, the support in the side where the image on the element is not finally used preferably has a thickness (from 5 to 250 μm) smaller than the above-described range. Examples of this thin support include a film obtained by evaporating aluminum on PET.

In the case where the requirements for heat resistance and curling properties are severe, supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129 and JP-A-7-219144 are preferably used as the support for the light-sensitive material.

With respect to the method for imagewise exposing the light-sensitive material to record an image thereon, a method of exposing the light-sensitive material by emitting light from a light emitting diode or various lasers based on the image information transmitted via electric signals, and a method of outputting the image information on an image display apparatus such as CRT, liquid crystal display, electroluminescence display and plasma display and exposing the light-sensitive material directly or through an optical system may be used. Also, a method of arraying a plurality of point light sources such as LED or LD and simultaneously exposing a plurality of image elements may be preferably used as a method for writing the image information at high speed.

Examples of the light source used in recording an image on the light-sensitive material include light sources described in U.S. Pat. No. 4,500,626, (col. 56), JP-A-2-53378 and JP-A-2-54672, such as natural light, tungsten lamp, light emitting diode, laser and CRT. Also, the exposure methods described in these patent publications may be used. Furthermore, light sources using a blue-light emitting diode which is making a remarkable advance in recent years, in combination with a green light-emitting diode and a red light-emitting diode may also be used. In particular, the exposing devices described in JP-A-7-140567, JP-A-7-248549, JP-A-7-248541, JP-A-7-295115, JP-A-7-290760, JP-A-7-301868, JP-A-7-301869, JP-A-7-306481 and JP-A-8-15788 are preferably used.

Furthermore, the image exposure may also be performed using a wavelength conversion element in which a nonlinear optical material is combined with a coherent light source such as laser. The nonlinear optical material is a material capable of giving nonlinearity between polarization and electric field created on applying a strong photoelectric field such as laser light. For this material, an inorganic compound such as lithium niobate, potassium dihydrogen-phosphate (KDP), lithium iodate and $BaB_2O_4$, a urea derivative, a nitroaniline derivative, a nitropyridine-N-oxide derivative such as 3-methyl-4-nitropyridine-N-oxide (POM), or a compound described in JP-A-61-53462 and JP-A-62-210432 is preferably used. With respect to the form of the wavelength conversion element, a single crystal light guide type and a fiber type are known, and either one is useful.

The above-described image information may use image signals obtained from video camera or electronic still camera, television signals represented by National Television Signal Code (NTSC), image signals obtained by dividing an original image into a large number of pixels by a scanner, or image signals produced using a computer such as CG and CAD.

The image-forming material (light-sensitive material and/or dye-fixing material) of the present invention can be used for various uses. For example, the dye-fixing material after the heat development and transfer may be used as a positive or negative color print material. The light-sensitive material using a black dye-donating material and/or a mixture of yellow, magenta and cyan dye-donating materials may be used as a black-and-white positive or negative printing material, as a graphic material such as a lithographic light-sensitive material, or as an X-ray photographic material.

In the case of using the image-forming material of the present invention as a material for use in performing the printing from a camera-work material, it is preferred to use a camera-work material having a function of recording information described in JP-A-6-163450 and JP-A-4-338944, and to subject the light-sensitive material of the present invention to exposure, heat development and a dye transfer, to thereby form a print on the dye-fixing material of the present invention. Examples of this printing method which can be used include those described in JP-A-5-241251, JP-A-5-19364 and JP-A-5-19363. The light-sensitive material after the heat development and transfer may be used as a camera-work material after an appropriately desilvering treatment. In this case, a support having a magnetic layer described, for example, in JP-A-4-124645, JP-A-5-40321, JP-A-6-35092 and JP-A-6-317875 is preferably used as the support, so that the photographing information can be recorded thereon.

The light-sensitive material and/or the dye-fixing material of the present invention may comprise an electrically conductive heating element layer as a heating means for heat development and diffusion transfer of dye. In this case, the heating element described in JP-A-61-145544 may be used.

The heating temperature at the heat development process is from about 50 to 250° C. but a heating temperature of about 60 to 180° C. is particularly useful. The diffusion transfer of dye may be performed simultaneously with or after the heat development process. In the latter case, the heating temperature at the transfer process may be from the temperature at the heat development to room temperature but the temperature is preferably from 50° C. to a temperature about 10° C. lower than the temperature at the heat development.

The dye may be induced to transfer only by heat but in order to accelerate the transfer of dye, a solvent may be used. Also, a method of heating the system in the presence of a small amount of a solvent (particularly water) to simultaneously or continuously perform the development and the transfer described in U.S. Pat. Nos. 4,704,345 and 4,740,445, and JP-A-61-238056 is useful. In this method, the heating temperature is preferably from 50° C. to a temperature lower than the boiling point of the solvent, for example, in the case where the solvent is water, the heating temperature is preferably from 50 to 100° C.

Examples of the solvent used for accelerating the development and/or diffusing and transferring a dye include water, a basic aqueous solution containing an inorganic alkali metal salt or an organic base (for this base, those described in relation to the image formation accelerator may be used), a low boiling solvent, and a mixture of a low boiling solvent and water or the above-described basic aqueous solution. In addition, a surface active agent, an antifoggant, a compound of forming a complex with a sparingly soluble metal salt, an antifungal and an antiseptic may be contained in the solvent.

The solvent used in the heat development and diffusion transfer processes is preferably water and the water may be any as long as it is commonly used water. Specific examples of the water which can be used include distilled water, tap water, well water and mineral water. In the heat developing device using the image-forming material (light-sensitive material and dye-fixing material) of the present invention, water may be used up or may be repeatedly used by circulating it. In the latter case, the water used contains components dissolved out from the materials. Furthermore, devices and water described in JP-A-63-144354, JP-A-63-144355, JP-A-62-38460 and JP-A-3-210555 may also be used. The solvent may be imparted to the light-sensitive material, the dye-fixing material or both thereof. The amount of the solvent used may be lower than the weight of the solvent corresponding to the maximum swelled volume of the entire coated film.

For imparting the water, a method described, for example, in JP-A-62-253159 (page 5) and JP-A-63-85544 is preferably used. Furthermore, a method of previously incorporating the solvent in the form of a microcapsule or a hydrate into the light-sensitive material, the dye-fixing material or both thereof may also be used. The temperature of water imparted may be from 30 to 60° C. as described in JP-A-63-85544.

In order to accelerate the transfer of dye, a method of incorporating a hydrophilic heat solvent which is solid at an ordinary temperature but dissolves at high temperatures, into the light-sensitive material and/or the dye-fixing material may also be used. The layer where the hydrophilic heat solvent is incorporated may be any of a light-sensitive silver halide emulsion layer, an interlayer, a protective layer and a dye fixing layer, but the hydrophilic heat solvent is preferably incorporated into a dye fixing layer and/or a layer adjacent thereto. Examples of the hydrophilic heat solvent include ureas, pyridines, amides, sulfonamides, imides, alcohols, oximes and other heterocyclic rings.

Examples of the heating method for use in the development and/or transfer process include a method of contacting the image-forming material with a heated block or plate, a hot plate, a hot presser, a heat roller, a heat drum, a halogen lamp heater, an infrared or far infrared lamp heater, and a method of passing the image-forming material through a high temperature atmosphere. For superposing the light-sensitive material on the dye-fixing material, a method described in JP-A-62-253159 and JP-A-61-147244 (page 27) may be used.

In the processing of the photographic element of the present invention, various development devices any may be used according to the purpose. For example, devices described in JP-A-59-75247, JP-A-59-177547, JP-A-59-181353, JP-A-60-18951, JU-A-62-25944 (the term "JU-A" as used herein means an "unexamined published Japanese utility model application" ), JP-A-6-130509, JP-A-6-95338, JP-A-6-95267, JP-A-8-29955 and JP-A-8-29954 are preferably used. Also, a commercially available device may be used and examples thereof include Pictrostat 100, Pictrostat 200, Pictrostat 300, Pictrostat 330, Pictrography 3000 and Pictrography 4000 manufactured by Fuji Photo Film Co., Ltd.

The light-sensitive material of the present invention is described below by referring to the Example, however, the present invention should not be construed as being limited thereto.

EXAMPLE 1

The preparation method of a light-sensitive silver halide emulsions is described below.

Light-sensitive Silver Halide Emulsion (1) (Emulsion for Fifth Layer (Light-sensitive Layer for 680 nm))

To an aqueous solution having the composition shown in Table 1 under thorough stirring, Solutions (I) and (II) each having the composition shown in Table 2 were simultaneously added over 19 minutes. After 5 minutes, Solutions (III) and (IV) each having the composition shown in Table 2 were added over 33 minutes and over 33 minutes and 30 seconds, respectively.

TABLE 1

| Composition | |
|---|---|
| $H_2O$ | 620 ml |
| Lime-treated gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

Silver Halide Solvent (1)

TABLE 2

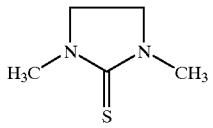

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.039 mg |
| Total amount | Water added to make 126 ml | Water added to make 132 ml | Water added to make 254 ml | Water added to make 252 ml |

Furthermore, 15 minutes after the initiation of adding Solution (III), 150 ml of an aqueous solution containing 0.350% of Sensitizing Dye (1) was added over 27 minutes.

Sensitizing Dye (1)

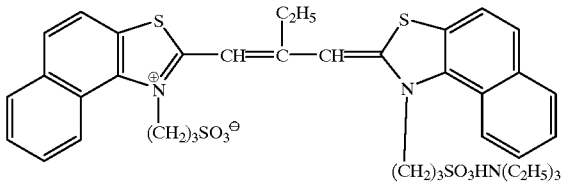

The emulsion was then washed with water and desalted by an ordinary method (at a pH of 3.7 to 4.1 using a precipitant a) and thereto, 22 g of lime-treated ossein gelatin was added. Thereafter, the pH and the pAg were adjusted to 6.0 and 7.9, respectively, and then the emulsion was chemically sensitized at 60° C. The compounds used for the chemical sensitization are shown in Table 3. The emulsion obtained in a yield of 630 g was a monodisperse emulsion comprising cubic silver chlorobromide grains having a coefficient of variation of 10.2% and an average grain size of 0.20 $\mu$m.

Precipitant a

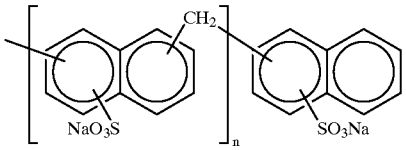

TABLE 3

| Chemicals Used in Chemical Sensitization | Amount Added |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| Antiseptic (1) | 0.07 g |
| Antiseptic (2) | 3.13 g |

Antifoggant (1)

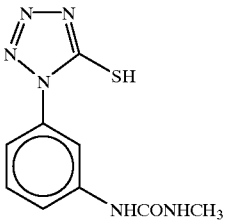

Antiseptic (1)

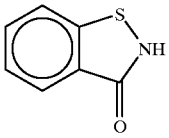

Antiseptic (2)

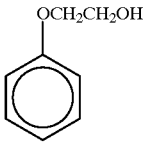

Light-sensitive Silver Halide Emulsion (2) (Emulsion for Third Layer (Light-sensitive Layer for 750 nm))

To an aqueous solution having the composition shown in Table 4 under thorough stirring, Solutions (I) and (II) each having the composition shown in Table 5 were simultaneously added over 18 minutes. After 5 minutes, Solutions (III) and (IV) each having the composition shown in Table 5 were added over 24 minutes and over 24 minutes and 30 seconds, respectively.

TABLE 4

| Composition | |
|---|---|
| $H_2O$ | 620 ml |
| Lime-treated gelatin | 20 g |
| KBr | 0.3 g |
| NaCl | 2 g |
| Silver Halide Solvent (1) shown above | 0.030 g |
| Sulfuric acid (1N) | 16 ml |
| Temperature | 45° C. |

TABLE 5

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_4[Fe(CN)_6]H_2O$ | — | — | — | 0.065 g |
| $K_2IrCl_6$ | — | — | — | 0.040 mg |
| Total amount | Water added to make 188 ml | Water added to make 188 ml | Water added to make 250 ml | Water added to make 250 ml |

The emulsion was then washed with water and desalted by an ordinary method (at a pH of 3.9 using a precipitant b) and thereto, 22 g of lime-treated ossein gelatin having been subjected to treatment for removing calcium (calcium content: 150 ppm or less) was added. Thereafter, the emulsion was redispersed at 40° C., 0.39 g of 4-hydroxy-6-methyl-1,3,3a,7-tetrazaindene was added to adjust the pH and the pAg to 5.9 and 7.8, respectively, and then the emulsion was chemically sensitized at 70° C. The compounds used for the chemical sensitization are shown in Table 6. During the chemical sensitization, a methanol solution of Sensitizing Dye (2) (a solution having the composition shown in Table 7) was added and after the chemical sensitization, the temperature was lowered to 40° C. and thereto 200 g of a gelatin dispersion of Stabilizer (1) was added. The resulting emulsion was thoroughly stirred and then stored. The emulsion obtained in a yield of 938 g was a monodisperse emulsion comprising cubic silver chlorobromide grains having a coefficient of variation of 12.6% and an average grain size of 0.25 $\mu$m.

TABLE 6

| Chemicals Used in Chemical Sensitization | Amount Added |
|---|---|
| 4-Hydroxy-6-methyl-1,3,3a,7-tetrazaindene | 0.39 g |
| Triethylthiourea | 3.3 mg |
| Nucleic acid decomposition product | 0.39 mg |
| NaCl | 0.15 g |
| KI | 0.12 g |
| Antifoggant (2) | 0.10 g |
| Antiseptic (1) shown above | 0.07 g |

TABLE 7

| Composition of Dye Solution | Amount Added |
|---|---|
| Sensitizing Dye (2) | 0.19 g |
| Methanol | 18.7 ml |

Stabilizer (1)

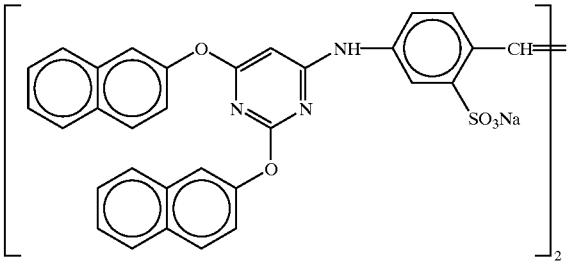

Antifoggant (2)

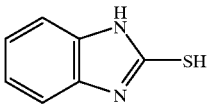

Precipitant b

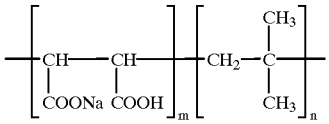

m:n = 1:1
(by weight)

Sensitizing Dye (2)

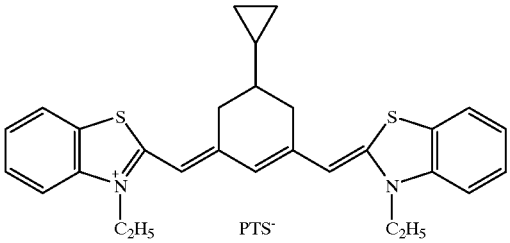

PTS: paratoluenesulfonic acid

Light-sensitive Silver Halide Emulsion (3) (Emulsion for First Layer (Light-sensitive Layer for 810 nm))

To an aqueous solution having the composition shown in Table 8 under thorough stirring, Solutions (I) and (II) each having the composition shown in Table 9 were simultaneously added over 18 minutes. After 5 minutes, Solutions (III) and (IV) each having the composition shown in Table 9 were added over 24 minutes and over 24 minutes and 30 seconds, respectively.

TABLE 8

| Composition | |
|---|---|
| $H_2O$ | 620 ml |
| Lime-treated gelatin | 20 g |
| KBr | 0.3 g |
| NaCl | 2 g |

TABLE 8-continued

| Composition | |
|---|---|
| Silver Halide Solvent (1) shown above | 0.030 g |
| Sulfuric acid (1N) | 16 ml |
| Temperature | 50° C. |

TABLE 9

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.6 g | — | 2.4 g |
| $K_2IrCl_6$ | — | — | — | 0.020 mg |
| $K_4[Fe(CN)_6]H_2O$ | — | — | — | 0.04 g |
| Total amount | Water added to make 180 ml | Water added to make 181 ml | Water added to make 242 ml | Water added to make 250 ml |

The emulsion was then washed with water and desalted by an ordinary method (at a pH of 3.8 using a precipitant a shown above) and thereto, 22 g of lime-treated ossein gelatin was added. Thereafter, the pH and the pAg were adjusted to 7.4 and 7.8, respectively, and then the emulsion was chemically sensitized at 60 ° C. The compounds used for the chemical sensitization are shown in Table 10. The emulsion obtained in a yield of 683 g was a monodisperse emulsion comprising cubic silver chlorobromide grains having a coefficient of variation of 9.7% and an average grain size of 0.32 $\mu$m.

TABLE 10

| Chemicals Used in Chemical Sensitization | Amount Added |
|---|---|
| 4-Hydroxy-6-methyl-1,3,3a,7-tetrazaindene | 0.38 g |
| Triethylthiourea | 3.10 mg |
| Antifoggant (2) shown above | 0.19 g |
| Antiseptic (1) shown above | 0.07 g |
| Antiseptic (2) shown above | 3.13 g |

The preparation method of fine silver chloride grains added to the first layer (light-sensitive layer for 810 nm) is described below.

To an aqueous solution having the composition shown in Table 11 under thorough stirring, Solutions (I) and (II) each having the composition shown in Table 12 were simultaneously added over 4 minutes. After 3 minutes, Solutions (III) and (IV) each having the composition shown in Table 12 were added each over 8 minutes.

TABLE 11

| Composition | |
|---|---|
| $H_2O$ | 3,770 ml |
| Lime-treated gelatin | 60 g |
| NaCl | 0.8 g |
| Temperature | 38° C. |

TABLE 12

| | Solution (I) | Solution (II) | Solution (III) | Solution (IV) |
|---|---|---|---|---|
| $AgNO_3$ | 300 g | — | 300 g | — |
| $NH_4NO_3$ | 10 g | — | 10 g | — |
| NaCl | — | 108 g | — | 104 g |
| Total amount | Water added to make 940 ml | Water added to make 940 ml | Water added to make 1,170 ml | Water added to make 1,080 ml |

The emulsion was then washed with water and desalted by an ordinary method (at a pH of 3.9 using a precipitant a shown above) and thereto, 132 g of lime-treated gelatin was added. Thereafter, the emulsion was redispersed at 35° C. thereto, 4 g of 4-hydroxy-6-methyl-1,3,3a,7-tetrazaindene was added and the pH was adjusted to 5.7. The emulsion obtained in a yield of 3,200 g was a silver chloride fine grain emulsion having an average grain size of 0.10 μm.

The preparation method of a gelatin dispersion of colloidal silver is described below.

To an aqueous solution having the composition shown in Table 13 under thorough stirring, a solution having the composition shown in Table 14 was added over 24 minutes. Thereafter, the emulsion was then washed with water using a precipitant a shown above, 43 g of lime-treated ossein gelatin was added thereto, and the pH was adjusted to 6.3. The average grain size was 0.02 μm and the yield was 512 g (a dispersion containing 2% of silver and 6.8% of gelatin).

TABLE 13

| Composition | |
|---|---|
| $H_2O$ | 620 ml |
| Dextrin | 16 g |
| NaOH (5N) | 41 ml |
| Temperature | 30° C. |

TABLE 14

| Composition | |
|---|---|
| $H_2O$ | 135 ml |
| $AgNO_3$ | 17 g |

The preparation method of a gelatin dispersion of each hydrophobic additive is described below.

A gelatin dispersion of the compound represented by formula (I) or (II) was prepared according to the formulation shown in Table 15. That is, the oil phase componets were dissolved under heating at about 60° C., were added thereto, and the solution were mixed under stirring and then dispersed in a homogenizer at 10,000 rpm for 10 minutes to obtain a homogeneous dispersion. From the thus-obtained dispersion, ethyl acetate was removed using a vacuum organic solvent-removing device.

TABLE 15

| | Dispersion Composition | | | |
|---|---|---|---|---|
| | N-1 | N-2 | N-3 | N-4 |
| Oil Layer | | | | |
| Compound R-1 | 7.5 g | — | — | 1.25 g |
| Compound R-5 | — | 9.0 g | — | 9.22 g |
| Compound R-8 | — | — | 5.47 g | — |
| High Boiling Point Solvent (1) | 4.8 g | — | — | — |
| High Boiling Point Solvent (2) | — | — | 4.8 g | 4.8 g |
| High Boiling Point Solvent (4) | — | 5.5 g | — | — |
| Surface Active Agent (1) | 1.9 g | 3.9 g | 1.9 g | 1.9 g |
| Ethyl Acetate | 16 ml | 12.3 ml | 12.8 ml | 12.8 ml |
| Aqueous Layer | | | | |
| Lime-treated gelatin | 10 g | 20.5 g | 10 g | 10 g |
| Antiseptic (3) | 0.002 g | 0.004 g | 0.002 g | 0.002 g |
| Antiseptic (4) | 0.004 g | 0.008 g | 0.004 g | 0.004 g |
| Calcium nitrate | 0.1 g | 0.2 g | 0.1 g | 0.1 g |
| Water | 136.7 ml | 121.9 ml | 138.7 ml | 133.7 ml |
| Total | 161 g | 161 g | 161 g | 161 g |

High-Boiling Point Solvent (1)

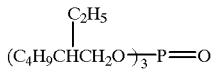

High-Boiling Point Solvent (2)

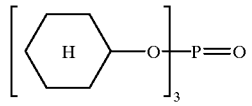

Surface Active Agent (1)

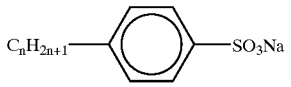

n ≐ 12.6

High-Boiling Point Solvent (4)

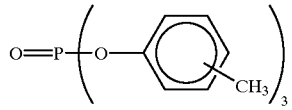

Antiseptic (3)

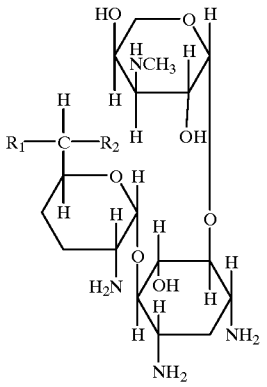

Antiseptic (4)

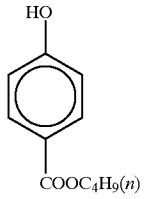

The preparation method of a gelatin dispersion of dye-donating compounds is described below.

Gelatin dispersions of a yellow dye-donating compound, a magenta dye-donating compound and a cyan dye donating compound each was prepared according to the formulation shown in Table 16. That is, oil phase components for each gelatin dispersion were dissolved under heating at about 70° C. to form a uniform solution and after aqueous phase components heated at about 60° C. were added thereto, the solutions were mixed under stirring and then dispersed in a homogenizer at 10,000 rpm for 10 minutes. To the resulting dispersed solution, water was added and stirred to obtain a homogeneous dispersion. Furthermore, the gelatin dispersion of a cyan dye-donating compound was repeatedly subjected to dilution with water and concentration using an ultrafiltration module (ultrafiltration module: ACV-3050, manufactured by Asahi Chemical Industry Co., Ltd.) to reduce the amount of ethyl acetate to 1/17.6 of the amount of ethyl acetate shown in Table 16.

TABLE 16

(Gelatin Dispersion of Hydrophobic Additives)

| | Dispersion Composition | | |
|---|---|---|---|
| | Yellow | Magenta | Cyan |
| Oil layer | | | |
| Yellow Dye-Donating Compound (1) | 1.68 g | — | — |
| Yellow Dye-Donating Compound (2) | 4.03 g | — | — |
| Magenta Dye-Donating Compound (2) | — | 5.27 g | — |
| Cyan Dye-Donating Compound (2) | — | — | 4.45 g |
| Reducing Agent (1) | 0.47 g | 0.06 g | 0.29 g |
| Antifoggant (3) | 0.1 g | — | 0.06 g |
| Antifoggant (4) | — | 0.21 g | — |
| Surface Active Agent (1) shown above | 0.6 g | 0.23 g | 0.45 g |
| High-Boiling point Solvent (1) shown above | 0.84 g | — | 1.34 g |
| High-Boiling Point Solvent (2) shown above | 2.01 g | 2.63 g | 4.47 g |
| Development Accelerator (1) | 1.01 g | — | — |
| Dye (a) | 0.59 g | — | 0.14 g |
| Water | 0.19 ml | — | 0.3 ml |
| Ethyl acetate | 10 ml | 16 ml | 16 ml |
| Aqueous layer | | | |
| Lime-treated gelatin | 5.5 g | 3.1 g | 2.4 g |
| Calcium nitrate | 0.05 g | 0.04 g | — |
| Aqueous sodium hydroxide solution (1N) | — | — | 0.07 g |
| Carboxymethyl cellulose | — | — | 31 g |
| Water | 35 ml | 31 ml | 40 ml |
| Water added after emulsification | 40 ml | 43 ml | 0.03 ml |
| Antiseptic (1) shown above | 0.003 g | 0.002 g | 0.001 g |

Yellow Dye-Donating Compound (1)

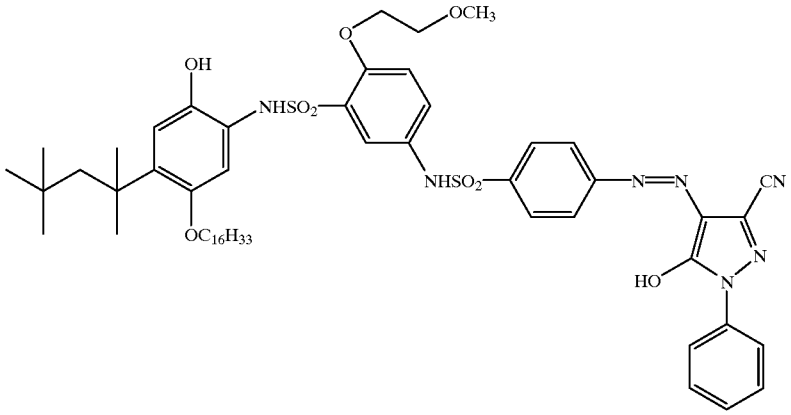

Yellow Dye-Donating Compound (2)
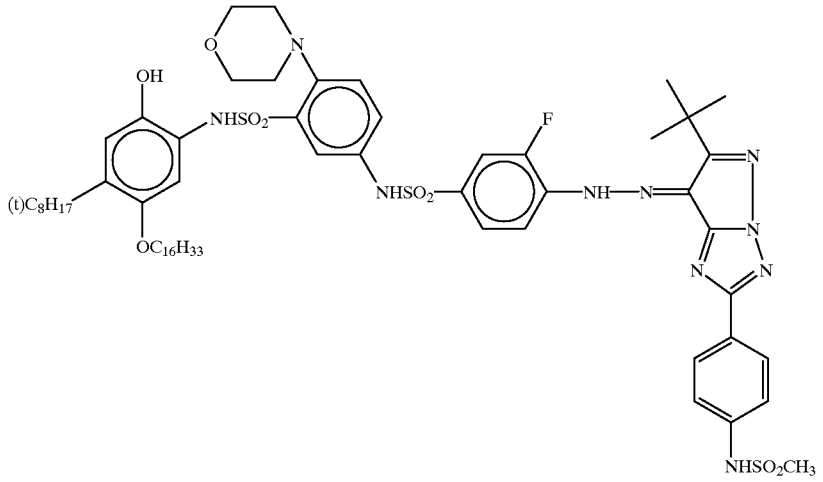
Magenta Dye-Donating Compound (2)
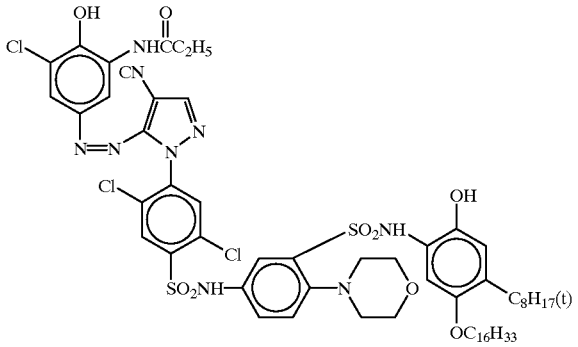
Cyan Dye-Donating Compound (2)
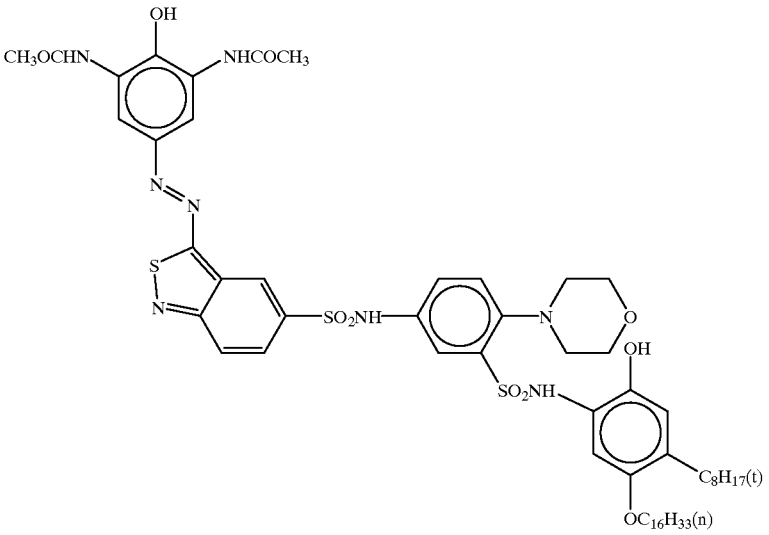

Reducing Agent (1)

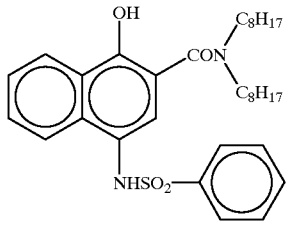

Antifoggant (3)

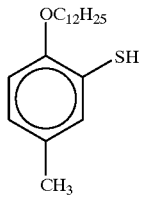

Antifoggant (4)

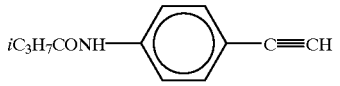

Developement Accelerator (1)

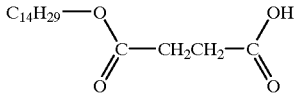

Dye (a)

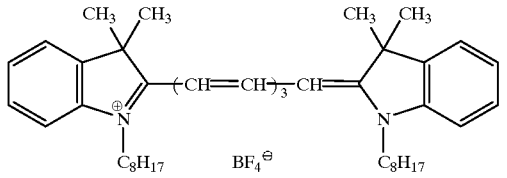

A gelatin despersion of Antifoggant (4) was prepared according to the formulation shown in Table 17. That is, the oil phase components were dissolved under heating at about 60° C. and after aqueous phase components heated at about 60° C. were added thereto, the solutions were mixed under stirring and then dispersed in a homogenizer at 10,000 rpm for 10 minutes to obtain a homogeneous solution.

TABLE 17

| | Dispersion Composition |
|---|---|
| Oil phase | |
| Antifoggant (4) shown above | 0.8 g |
| Reducing Agent (1) shown above | 0.1 g |
| High Boiling Point Solvent (2) shown above | 2.4 g |
| High Boiling Point Solvent (3) | 0.2 g |
| Surface Active Agent (1) shown above | 0.5 g |

TABLE 17-continued

| | Dispersion Composition |
|---|---|
| Surface Active Agent (7) | 0.5 g |
| Ethyl acetate | 10.0 ml |
| Aqueous phase | |
| Lime-treated gelatin | 10.0 g |
| Antiseptic (1) shown above | 0.004 g |
| Calcium nitrate | 0.1 g |
| Water | 35.0 ml |
| Water added | 46.0 ml |

A dispersion of Polymer Latex (a) was prepared according to the formulation shown in Table 18. That is, while stirring the mixture solution of Polymer Latex (a), Surface Active Agent (4) and water each in an amount shown in Table 18, Surface Active Agent (5) was added over 10 minutes to obtain a homogeneous dispersion. The dispersion obtained was repeatedly subjected to dilution with water and concentration using an ultrafiltration module (ultrafiltration module: ACV-3050, manufactured by Asahi Chemical Industry Co., Ltd.) to reduce the salt concentration in the dispersion to 1/9.

TABLE 18

| | Dispersion Composition |
|---|---|
| Aqueous solution of Polymer Latex (a) (solid contents: 13%) | 108.0 ml |
| Surface Active Agent (4) | 20.0 g |
| Aqueous solution of Surface Active Agent (5) (5%) | 600.0 ml |
| Water | 1232.0 ml |

A gelatin dispersion of Stabilizer (1) was prepared according to the formulation shown in Table 19. That is, the oil phase components were dissolved at room temperature, the aqueous phase components heated at about 40° C. were added thereto, the solutions were mixed under stirring and then dispersed in a homogenizer at 10,000 rpm for 10 minutes, water was added thereto, and the resulting solution was stirred to obtain a homogeneous dispersion.

TABLE 19

| | Dispersion Composition |
|---|---|
| Oil phase | |
| Stabilizer (1) shown above | 4.0 g |
| Sodium hydroxide | 0.3 g |
| Methanol | 62.8 g |
| High Boiling Point Solvent (2) shown above | 0.9 g |
| Aqueous phase | |
| Gelatin subjected to removal of calcium (Ca content: 100 ppm or less) | 10.0 g |
| Antiseptic (1) shown above | 0.04 g |
| Water | 320.5 ml |

A gelatin dispersion of zinc hydroxide was prepared according to the formulation shown in Table 20. That is, respective components were mixed, dissolved and then dispersed in a mill using glass beads having an average particle size of 0.75 mm for 30 minutes, and thereafter, the glass beads were separated and removed to obtain a homogenous dispersion (the average particle size of zinc hydroxide used was 0.25 μm).

TABLE 20

| | Dispersion Composition |
|---|---|
| Zinc hydroxide | 15.9 g |
| Carboxymethyl cellulose | 0.7 g |
| Sodium polyacrylate | 0.07 g |
| Lime-treated gelatin | 4.2 g |
| Water | 100 ml |
| High Boiling Point Solvent (2) shown above | 0.4 g |

The preparation method of a gelatin dispersion of a matting agent added to the protective layer is described below. A solution obtained by dissolving PMMA in methylene chloride was added to gelatin together with a small amount of surface active agent and dispersed while stirring at a high speed. Subsequently, methylene chloride was removed using a vacuum solvent-removing device to obtain a homogeneous dispersion having an average particle size of 4.3 μm.

High-Boiling Point Organic Solvent (3)

$C_{28}H_{48.9}Cl_{7.1}$

Empara 40 (produced by Ajinomoto)

Surface Active Agent (7)

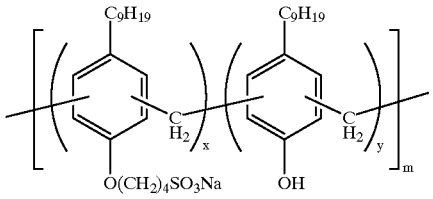

x:y = 4:6
m ≒ 6.8

Polymer Latex (a)

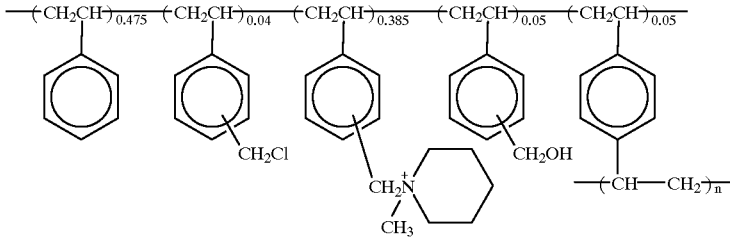

Surface Active Agent (2)

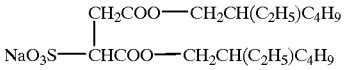

Surface Active Agent (3)

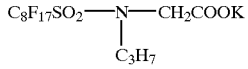

Surface Active Agent (4)

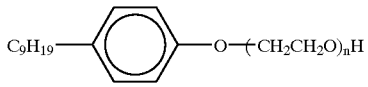

n = 50

Surface Active Agent (5)

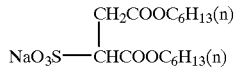

Surface Active Agent (6)

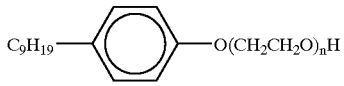

n = 20

Antifoggant (5)

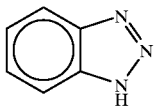

Hardening Agent (1)

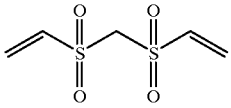

Using those prepared above, Heat-Developable Color Light-Sensitive Material 101 shown in Table 21 was prepared. In the following Tables, sensitizing dye, antifoggant and the like added together with the light-sensitive silver halide, and trace additives such as antiseptic, were omitted.

TABLE 21

(Construction of Light-Sensitive Material 101)

| No. of Layer | Name of Layer | Additive | Amount Coated (mg/m$^2$) |
|---|---|---|---|
| 8th Layer | Protective Layer | Acid-treated gelatin | 1,171 |
| | | Colloidal silver particles | 2 |
| | | Matting agent (PMMA resin) | 16 |
| | | Surface Active Agent (2) | 29 |
| | | Surface Active Agent (3) | 26 |
| | | Surface Active Agent (4) | 11 |
| | | Surface Active Agent (5) | 15 |
| | | Polymer Latex (a) | 18 |
| | | Calcium nitrate | 5 |
| 7th Layer | Light-Sensitive Layer for 680 nm | Lime-treated gelatin | 399 |
| | | Light-Sensitive Silver Halide Emulsion (1) | 267 |
| | | Magenta Dye-Donating Compound (2) | 455 |
| | | High Boiling Point Solvent (2) | 261 |
| | | Reducing Agent (1) | 5.5 |
| | | Antifoggant (4) | 18 |
| | | Surface Active Agent (1) | 20 |
| | | Water-Soluble Polymer (1) | 8.6 |
| 6th Layer | Interlayer | Lime-treated gelatin | 646 |
| | | Zinc hydroxide | 906 |
| | | Surface Active Agent (2) | 3.7 |
| | | Water-Soluble Polymer (1) | 5.5 |
| | | Calcium nitrate | 10 |
| 5th Layer | Light-Sensitive Layer for 750 nm | Lime-treated gelatin | 337 |
| | | Light-Sensitive Silver Halide Emulsion (2) | 153 |
| | | Stabilizer (1) | 12 |
| | | Cyan Dye-Donating Compound (2) | 357 |
| | | Dye (a) | 11 |
| | | High Boiling Point Solvent (1) | 107 |
| | | High Boiling Point Solvent (2) | 358 |
| | | Reducing Agent (1) | 23 |
| | | Antifoggant (3) | 4.3 |
| | | Surface Active Agent (1) | 36 |
| | | Carboxymethyl cellulose | 5.8 |
| | | Water-Soluble Polymer (1) | 7.1 |
| 4th Layer | Interlayer | Lime-treated gelatin | 632 |
| | | Antifoggant (4) | 8.5 |
| | | Antifoggant (5) | 3.9 |
| | | Surface Active Agent (1) | 7.4 |
| | | Surface Active Agent (2) | 4.1 |
| | | Surface Active Agent (6) | 71 |
| | | Surface Active Agent (7) | 5 |
| | | High-Boiling Point Solvent (2) | 26 |
| | | High-Boiling Point Solvent (3) | 2.6 |
| | | Reducing Agent (1) | 1.1 |
| | | Water-Soluble Polymer (2) | 13 |
| | | Calcium nitrate | 6 |
| 3rd Layer | Light-Sensitive Layer for 810 nm | Lime-treated gelatin | 581 |
| | | Light-Sensitive Silver Halide Emulsion (3) | 313 |
| | | Fine grain silver chloride | 40 |
| | | Stabilizer (1) | 8.3 |
| | | Yellow Dye-Donating Compound (1) | 124 |

TABLE 21-continued (Construction of Light-Sensitive Material 101)

| No. of Layer | Name of Layer | Additive | Amount Coated (mg/m$^2$) |
|---|---|---|---|
| | | Yellow Dye-Donating Compound (2) | 297 |
| | | Sensitizing Dye (3) | 0.1 |
| | | Dye (a) | 44 |
| | | High-Boiling Point Solvent (1) | 62 |
| | | High-Boiling Point Solvent (2) | 149 |
| | | Surface Active Agent (1) | 43 |
| | | Reducing Agent (1) | 34 |
| | | Development Accelerator (1) | 74 |
| | | Antifoggant (3) | 6.5 |
| | | Water-Soluble Polymer (2) | 43 |
| | | Hardening Agent (1) | 47 |
| 2nd Layer | Interlayer | Lime-treated gelatin | 426 |
| | | Antifoggant (4) | 5.7 |
| | | Antifoggant (5) | 2.6 |
| | | Surface Active Agent (1) | 5 |
| | | Surface Active Agent (2) | 2.8 |
| | | Surface Active Agent (6) | 48 |
| | | Surface Active Agent (7) | 3.6 |
| | | High-Boiling Point Solvent (2) | 18 |
| | | High-Boiling Point Solvent (3) | 1.8 |
| | | Reducing Agent (1) | 0.7 |
| | | Water-Soluble Polymer (2) | 8.8 |
| | | Calcium nitrate | 4 |
| 1st Layer | Interlayer | Lime-treated gelatin | 293 |
| | | High-Boiling Point Solvent (2) | 64 |
| | | Surface Active Agent (1) | 25 |
| | | Sodium hydrogensulfite | 2.9 |

Note: The chemical formulae of the additives described in Table 21 other than Water-Soluble Polymers (1) and (2) and Sensitizing Dye (3) are shown above.

Light-Sensitive Materials 102 to 112 were prepared in the same manner as Light-Sensitive Material 101 except for adding a compound represented by formula (I) or (II) to Light-Sensitive Material 101. The number of compound, the amount added and the layer to which added are shown in Table 22.

TABLE 22

| | Number of Emulsified Product | Compound | Amount added (mg/m$^2$) | Layer to Which Added | Remarks |
|---|---|---|---|---|---|
| 101 | none | none | — | — | Comparison |
| 102 | N-1 | R-1 | 47 | 1st Layer | Invention |
| 103 | " | " | 94 | " | Invention |
| 104 | N-2 | R-5 | 69 | " | Invention |
| 105 | " | " | 138 | " | Invention |
| 106 | " | " | 207 | " | Invention |
| 107 | N-3 | R-8 | 34 | " | Invention |
| 108 | " | " | 102 | " | Invention |
| 109 | N-4 | R-1 and R-5 | 66 | " | Invention |
| 110 | " | " | 133 | " | Invention |
| 111 | N-2 | R-5 | 138 | 2nd Layer | Comparison |
| 112 | " | " | " | 8th Layer | Comparison |

The preparation method of the dye-fixing material for use in the processing of the light-sensitive material of the present invention is described below. On the surface of a support shown in Table 23, layers were coated one on another to have a layer construction shown in Table 24, by preparing Dye-Fixing Material 201.

TABLE 23

| Name of Layer | Composition | | Layer Thickness (μm) |
|---|---|---|---|
| Surface undercoat layer | Geletin | | 0.1 |
| Surface PE layer (glossy) | Low-density polyethylene (density: 0.923): | 90.2 parts | 36.0 |
| | Surface-treated titanium oxide: | 9.8 parts | |
| | Ultramarine: | 0.001 part | |
| Pulp layer | Wood-free paper (LBKP/NBSP = 6/4, density: 1.053) | | 152.0 |
| Back PE layer (mat) | High-density polyethylene (density: 0.955) | | 27.0 |
| Back undercoat layer | Styrene/acrylate copolymer | | 0.5 |
| | Colloidal silica | | |
| | Sodium polystyrenesulfonate | | |
| | Polyvinyl alcohol | | |
| Total thickness | | | 215.6 |

TABLE 24

(Construction of Dye-Fixing Material 201)

| No. of Layer | Additive | Amount Coated (mg/m$^2$) |
|---|---|---|
| 6th Layer | Water-Soluble Polymer (1) | 130 |
| | Water-Soluble Polymer (2) | 35 |
| | Water-Soluble Polymer (3) | 45 |
| | Potassium nitrate | 20 |
| | Anionic Surface Active Agent (1) | 6 |
| | Anionic Surface Active Agent (2) | 6 |
| | Amphoteric Surface Active Agent (1) | 50 |
| | Stain Inhibitor (1) | 7 |
| | Stain Inhibitor (2) | 12 |
| | Matting Agent (1) | 7 |

TABLE 24-continued (Construction of Dye-Fixing Material 201)

| No. of Layer | Additive | Amount Coated (mg/m$^2$) |
|---|---|---|
| 5th Layer | Gelatin | 250 |
| | Water-Soluble Polymer (1) | 25 |
| | Anionic Surface Active Agent (3) | 9 |
| | Hardening Agent (2) | 185 |
| 4th Layer | Mordant (2) | 1850 |
| | Water-Soluble Polymer (2) | 260 |
| | Water-Soluble Polymer (4) | 1400 |
| | Latex Dispersion (1) | 600 |
| | Anionic Surface Active Agent (3) | 25 |
| | Nonionic Surface Active Agent (1) | 18 |
| | Citric Acid | 15 |
| | Guanidine picolinate | 2550 |
| | Sodium quinolinate | 350 |
| 3rd Layer | Gelatin | 370 |
| | Mordant (1) | 300 |
| | Anionic Surface Active Agent (3) | 12 |
| 2nd Layer | Gelatin | 700 |
| | Mordant (1) | 290 |
| | Water-Soluble Polymer (1) | 55 |
| | Water-Soluble Polymer (2) | 330 |
| | Anionic Surface Active Agent (3) | 30 |
| | Surface Active Agent (7) shown above | 7 |
| | High-Boiling Point Organic Solvent (3) shown above | 700 |
| | Fluorescent Brightening Agent (1) | 30 |
| | Guanidine picolinate | 360 |
| | Potassium quinolinate | 45 |
| 1st Layer | Gelatin | 280 |
| | Water-Soluble Polymer (1) | 12 |
| | Anionic Surface Active Agent (1) | 14 |
| | Sodium metaborate | 35 |
| | Hardening Agent (2) | 185 |
| Support | paper support shown in Table 6 (thickness: 215.6 μm) | |

The coated amount of latex dispersion is a coated amount in terms of solid contents in the latex.

Sensitizing Dye (3)

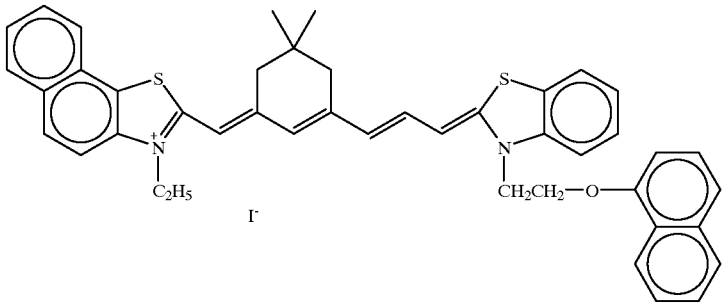

Anionic Surface Active Agent (1)

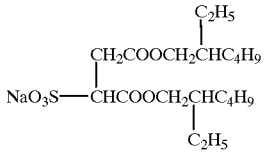

Anionic Surface Active Agent (2)

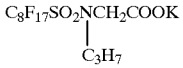

Anionic Surface Active Agent (3)

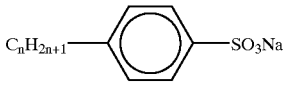

m ≈ 12.6

Nonionic Surface Active Agent (1)

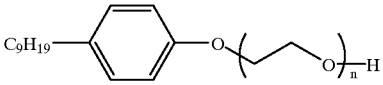

n = 85

Amphoteric Surface Active Agent (1)

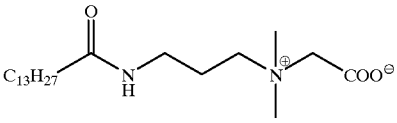

Flourescent Brightening Agent (1)

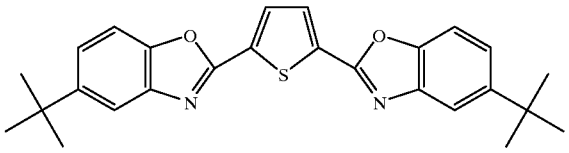

Mordant (1)

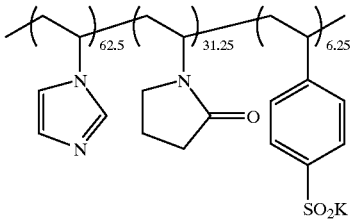

Stain Inhibitor (1)

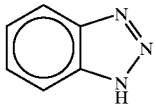

Stain Inhibitor (2)

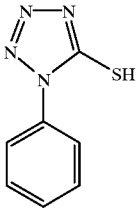

Water-Soluble Polymer (1)
Sumicagel L5-H (produced by Sumitomo Chemical)
Water-Soluble Polymer (2)
Dextran (molecular weight: 70,000)
Water-Soluble Polymer (3)
κ-carrageenan (produced by Taito)
Water-Soluble Polymer (4)
MP polymer MP-102 (produced by Kuraray)
Latex Dispersion (1)
LX-438 (produced by Nippon Zeon)

Mordant (2)

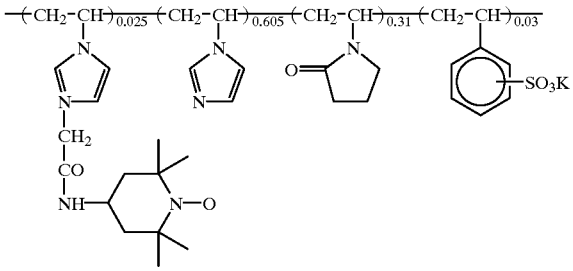

Matting Agent (1)
SYLOID79 (produced by Fuji Davidson Kagaku)

Hardening Agent (2)

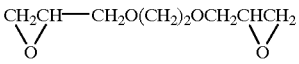

Light-Sensitive Material 101 was combined with Dye-Fixing Material 201 and then exposed and developed using Pictrography 3000 available from Fuji Photo Film Co., Ltd. to prepare a white sample and a gray sample having a density of 0.7 when measured by X-rite 310 Filter Status A (the exposure was performed by scanning exposure in which the exposure time was $1\times10^{-5}$ second or less per one picture element).

White samples and gray samples were prepared in the same manner as described above except that Light-Sensitive Materials 102 to 110 of the present invention and Comparative Light-Sensitive Materials 111 and 112 each was used in place of light-sensitive material 101.

The yellow density of each white sample was measured according to Filter Status A using a reflection densitometer X-Rite 310. The results obtained shown in Table 49. In the Table, the higher yellow density reveals greater fogging.

Furthermore, whether or not smoke-like uneven density of image is viewed on each white sample and whether or not uneven density of image is viewed on each gray sample were examined. The results obtained are shown together in Table 49.

For the comparison of the present invention, Light-Sensitive Material 201 was prepared as described below, wherein two light-insensitive layers were provided on a light-sensitive layer farthest from a support and compounds represented by the formula of the present invention were added in the uppermost layer.

The preparation method of a light-sensitive silver halide emulsions is described below. Light-sensitive Silver Halide Emulsion (4) (low-sensitivity emulsion for sixth layer (light-sensitive layer for 680 nm))

To an aqueous solution having the composition shown in Table 25 under thorough stirring, Solutions (I) and (II) each having the composition shown in Table 26 were simultaneously added over 9 minutes. After 5 minutes, Solutions (III) and (IV) each having the composition shown in Table 26 were added over 33 minutes and over 33 minutes and 30 seconds, respectively.

TABLE 25

| Composition | |
|---|---|
| $H_2O$ | 620 ml |
| Lime-treated gelatin | 20 g |
| KBr | 0.3 g |
| NaCl | 2 g |
| Silver Halide Solvent (1) shown above | 0.030 g |
| Sulfuric acid (1N) | 16 ml |
| Temperature | 45° C. |

TABLE 26

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.039 mg |
| Total amount | Water added to make 126 ml | Water added to make 132 ml | Water added to make 254 ml | Water added to make 252 ml |

Furthermore, 15 minutes after the initiation of adding Solution (III), 150 ml of an aqueous solution containing 0.350% of Sensitizing Dye (1) shown above was added over 27 minutes.

The emulsion was then washed with water and desalted by an ordinary method (at a pH of 4.1 using a precipitant a shown above) and thereto, 22 g of lime-treated ossein gelatin was added. Thereafter, the pH and the pAg were adjusted to 6.0 and 7.9, respectively, and then the emulsion was chemically sensitized at 60° C. The compounds used for the chemical sensitization are shown in Table 27. The emulsion obtained in a yield of 630 g was a monodisperse emulsion comprising cubic silver chlorobromide grains having a coefficient of variation of 10.2% and an average grain size of 0.20 $\mu$m.

TABLE 27

| Chemicals Used in Chemical Sensitization | Amount Added |
|---|---|
| 4-Hydroxy-6-methyl-1,3,3a,7-tetrazaindene | 0.36 g |
| Sodium thiosulfate | 6.75 mg |
| Antifoggant (1) shown above | 0.11 g |
| Antiseptic (1) shown above | 0.07 g |
| Antiseptic (2) shown above | 3.13 g |

Light-sensitive Silver Halide Emulsion (5) (high-sensitivity emulsion for sixth layer (light-sensitive layer for 680 nm))

To an aqueous solution having the composition shown in Table 28 under thorough stirring, Solutions (I) and (II) each having the composition shown in Table 29 were simultaneously added over 9 minutes. After 5 minutes, Solutions (III) and (IV) each having the composition shown in Table 29 were added over 33 minutes and over 33 minutes and 30 seconds, respectively.

TABLE 28

| Composition | |
|---|---|
| $H_2O$ | 620 ml |
| Lime-treated gelatin | 20 g |
| KBr | 0.3 g |
| NaCl | 2 g |
| Silver Halide Solvent (1) shown above | 0.030 g |
| Sulfuric acid (1N) | 16 ml |
| Temperature | 50° C. |

TABLE 29

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.058 mg |
| $(NH_4)_3RhCl_5 \cdot H_2O$ | — | 0.01 mg | — | — |
| Total amount | Water added to make 126 ml | Water added to make 132 ml | Water added to make 254 ml | Water added to make 252 ml |

Furthermore, 15 minutes after the initiation of adding Solution (III), 150 ml of an aqueous solution containing 0.350% of Sensitizing Dye (1) shown above was added over 21 minutes.

The emulsion was then washed with water and desalted by an ordinary method (at a pH of 4.1 using a precipitant a shown above) and thereto, 22 g of lime-treated ossein gelatin was added. Thereafter, the pH and the pAg were adjusted to 6.0 and 7.9, respectively, and then the emulsion was chemically sensitized at 60° C. The compounds used for the chemical sensitization are shown in Table 30. The emulsion obtained in a yield of 630 g was a monodisperse emulsion comprising cubic silver chlorobromide grains having a coefficient of variation of 10.2% and an average grain size of 0.25 $\mu$m.

TABLE 30

| Chemicals Used in Chemical Sensitization | Amount Added |
|---|---|
| 4-Hydroxy-6-methyl-1,3,3a,7-tetrazaindene | 0.36 g |
| Sodium thiosulfate | 6.75 mg |
| Antifoggant (1) shown above | 0.11 g |
| Antiseptic (1) shown above | 0.07 g |
| Antiseptic (2) shown above | 3.13 g |

Light-sensitive Silver Halide Emulsion (6) (emulsion for fourth layer (light-sensitive layer for 750 nm))

To an aqueous solution having the composition shown in Table 31 under thorough stirring, Solutions (I) and (II) each having the composition shown in Table 32 were simultaneously added over 18 minutes. After 5 minutes, Solutions (III) and (IV) each having the composition shown in Table 32 were added over 24 minutes and over 24 minutes and 30 seconds, respectively.

TABLE 31

| Composition | |
|---|---|
| $H_2O$ | 620 ml |
| Lime-treated gelatin | 20 g |
| KBr | 0.3 g |
| NaCl | 2 g |
| Silver Halide Solvent (1) shown above | 0.030 g |
| Sulfuric acid (1N) | 16 ml |
| Temperature | 41° C. |

TABLE 32

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 14.2 g | — | 43.7 g |
| NaCl | — | 3.8 g | — | 2.4 g |
| $K_4[Fe(CN)_6]H_2O$ | — | — | — | 0.065 g |
| $K_2IrCl_6$ | — | — | — | 0.057 mg |
| Total amount | Water added to make 188 ml | Water added to make 188 ml | Water added to make 250 ml | Water added to make 250 ml |

The emulsion was then washed with water and desalted by an ordinary method (at a pH of 3.9 using a precipitant b shown above) and thereto, 22 g of lime-treated ossein gelatin having been subjected to treatment for removing calcium (calcium content: 150 ppm or less) was added. Thereafter, the emulsion was redispersed at 40° C., 0.39 g of 4-hydroxy-6-methyl-1,3,3a,7-tetrazaindene was added to adjust the pH and the pAg to 5.9 and 7.8, respectively, and then the emulsion was chemically sensitized at 60° C. The compounds used for the chemical sensitization are shown in Table 33. During the chemical sensitization, a methanol solution of Sensitizing Dye (2) shown above (a solution having the composition shown in Table 34) was added and after the chemical sensitization, the temperature was lowered to 50° C. and thereto 200 g of a gelatin dispersion of Stabilizer (1) shown above was added. The preparation method of the gelatin dispersion of Stabilizer (1) is described later. The resulting emulsion was thoroughly stirred and then stored. The emulsion obtained in a yield of 938 g was a monodisperse emulsion comprising cubic silver chlorobromide grains having a coefficient of variation of 12.6% and an average grain size of 0.23 μm.

TABLE 33

| Chemicals Used in Chemical Sensitization | Amount Added |
|---|---|
| 4-Hydroxy-6-methyl-1,3,3a,7-tetrazaindene | 0.39 g |
| Triethylthiourea | 3.3 mg |
| Nucleic acid decomposition product | 0.39 mg |
| NaCl | 0.15 g |
| KI | 0.12 g |
| Antifoggant (2) shown above | 0.10 g |
| Antiseptic (1) shown above | 0.07 g |

TABLE 34

| Composition of Dye Solution | Amount Added |
|---|---|
| Sensitizing Dye (2) shown above | 0.19 g |
| Methanol | 18.7 ml |

Light-sensitive Silver Halide Emulsion (7) (emulsion for second layer (light-sensitive layer for 810 nm))

To an aqueous solution having the composition shown in Table 35 under thorough stirring, Solutions (I) and (II) each having the composition shown in Table 36 were simultaneously added over 18 minutes. After 5 minutes, Solutions (III) and (IV) each having the composition shown in Table 36 were added over 24 minutes and over 24 minutes and 30 seconds, respectively.

TABLE 35

| Composition | |
|---|---|
| $H_2O$ | 620 ml |
| Lime-treated gelatin | 20 g |
| KBr | 0.3 g |
| NaCl | 2 g |
| Silver Halide Solvent (1) shown above | 0.030 g |
| Sulfuric acid (1N) | 16 ml |
| Temperature | 50° C. |

TABLE 36

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_4[Fe(CN)_6]H_2O$ | — | — | — | 0.04 g |
| $K_2IrCl_6$ | — | — | — | 0.020 mg |
| Total amount | Water added to make 180 ml | Water added to make 181 ml | Water added to make 242 ml | Water added to make 250 ml |

The emulsion was then washed with water and desalted by an ordinary method (at a pH of 3.8 using a precipitant a shown above) and thereto, 22 g of lime-treated ossein gelatin was added. Thereafter, the pH and the pAg were adjusted to 7.4 and 7.8, respectively, and then the emulsion was chemically sensitized at 60° C. The compounds used for the chemical sensitization are shown in Table 37. The emulsion obtained in a yield of 683 g was a monodisperse emulsion comprising cubic silver chlorobromide grains having a coefficient of variation of 9.7% and an average grain size of 0.32 μm.

TABLE 37

| Chemicals Used in Chemical Sensitization | Amount Added |
|---|---|
| 4-Hydroxy-6-methyl-1,3,3a,7-tetrazaindene | 0.38 g |
| Triethylthiourea | 3.10 mg |
| Antifoggant(2) shown above | 0.19 g |
| Antiseptic (1) shown above | 0.07 g |
| Antiseptic (2) shown above | 3.13 g |

The preparation method of fine silver chloride grains added to the second layer (light-sensitive layer for 810 nm) is described below.

To an aqueous solution having the composition shown in Table 38 under thorough stirring, Solutions (I) and (II) each having the composition shown in Table 39 were simultaneously added over 4 minutes. After 3 minutes, Solutions (III) and (IV) each having the composition shown in Table 39 were added each over 8 minutes.

TABLE 38

| Composition | |
|---|---|
| $H_2O$ | 3,770 ml |
| Lime-treated gelatin | 60 g |
| NaCl | 0.8 g |
| Temperature | 38° C. |

TABLE 39

| | Solution (I) | Solution (II) | Solution (III) | Solution (IV) |
|---|---|---|---|---|
| $AgNO_3$ | 300 g | — | 300 g | — |
| $NH_4NO_3$ | 10 g | — | 10 g | — |
| NaCl | — | 108 g | — | 104 g |
| Total Amount | Water added to make 940 ml | Water added to make 940 ml | Water added to make 1,170 ml | Water added to make 1,080 ml |

The emulsion was then washed with water and desalted by an ordinary method (at a pH of 3.9 using a precipitant a shown above) and thereto, 132 g of lime-treated ossein gelatin was added. Thereafter, the emulsion was redispersed at 35° C. and thereto, 4 g of 4-hydroxy-6-methyl-1,3,3a,7-tetrazaindene was added and the pH was adjusted to 5.7. The emulsion obtained in a yield of 3,200 g was a silver chloride fine grain emulsion having an average grain size of 0.10 μm.

The preparation method of a gelatin dispersion of colloidal silver is described below.

To an aqueous solution having the composition shown in Table 40 under thorough stirring, a solution having the composition shown in Table 41 was added over 24 minutes. Thereafter, the emulsion was then washed with water using a precipitant a shown above, 43 g of lime-treated ossein gelatin was added thereto, and the pH was adjusted to 6.3. The average grain size was 0.02 μm and the yield was 512 g (a dispersion containing 2% of silver and 6.8% of gelatin).

TABLE 40

| Composition | |
|---|---|
| $H_2O$ | 620 ml |
| Dextrin | 16 g |
| NaOH (5N) | 41 ml |
| Temperature | 30° C. |

TABLE 41

| Composition | |
|---|---|
| $H_2O$ | 135 ml |
| $AgNO_3$ | 17 g |

The preparation method of a gelatin dispersion of each hydrophobic additive is described below.

A gelatin dispersion of Compounds R-1 and R-5 shown above (i.e., the compounds represented by formula (I) or (II) of the present invention) was prepared according to the formulation shown in Table 42. That is, the oil phase components were dissolved under heating at about 60° C., the aqueous phase components heated at about 60° C. were added thereto, and the solutions were mixed under stirring and then dispersed in a homogenizer at 10,000 rpm for 10 minutes to obtain a homogeneous dispersion. From the thus-obtained dispersion, ethyl acetate was removed using a vacuum organic solvent-removing device.

TABLE 42

| | | Dispersion Composition |
|---|---|---|
| Oil Layer | Compound R-1 shown above | 1.25 g |
| | Compound R-5 shown above | 9.22 g |
| | High Boiling Point Solvent (2) shown above | 4.8 g |
| | Surface Active Agent (1) shown above | 1.9 g |
| | Ethyl Acetate | 12.8 ml |
| Aqueous Layer | Acid-treated gelatin | 10 g |
| | Antiseptic (1) shown above | 0.025 g |
| | $NaHSO_3$ | 0.1 g |
| | Water | 137 ml |
| Total | | 176 g |

The preparation method of a gelatin dispersion of dye-donating compounds is described below.

Gelatin dispersions of a yellow dye-donating compound, a magenta dye-donating compound and a cyan dye donating compound each was prepared according to the formulation shown in Table 43. That is, oil phase components for each gelatin dispersion were dissolved under heating at about 70° C. to form a uniform solution and after aqueous phase components heated at about 60° C. were added thereto, the solutions were mixed under stirring and then dispersed in a homogenizer at 10,000 rpm for 10 minutes. To the resulting dispersed solution, water was added and stirred to obtain a homogeneous dispersion. Furthermore, the gelatin dispersion of a cyan dye-donating compound was repeatedly subjected to dilution with water and concentration using an ultrafiltration module (ultrafiltration module: ACV-3050, manufactured by Asahi Chemical Industry Co., Ltd.) to reduce the amount of ethyl acetate to 1/17.6 of the amount of ethyl acetate shown in Table 43.

TABLE 43

(Gelatin Dispersion of Hydrophobic Additives)

| | | Dispersion Composition | | |
|---|---|---|---|---|
| | | Yellow | Magenta | Cyan |
| Oil layer | Yellow Dye-Donating Compound (1) | 1.68 g | — | — |
| | Yellow Dye-Donating Compound (2) | 4.03 g | — | — |
| | Magenta Dye-Donating Compound (2) | — | 5.27 g | — |
| | Cyan Dye-Donating Compound (2) | — | — | 4.45 g |
| | Reducing Agent (1) | 0.47 g | 0.06 g | 0.29 g |
| | Antifoggant (3) | 0.09 g | — | 0.05 g |
| | Antifoggant (4) | — | 0.21 g | — |
| | High-Boiling Point Solvent (1) | 0.84 g | — | 1.34 g |
| | High-Boiling Point Solvent (2) | 2.01 g | 2.63 g | 4.47 g |
| | Surface Active Agent (1) | 0.6 g | 0.23 g | 0.45 g |
| | Development Accelerator (1) | 1.01 g | — | — |
| | Dye (a) | 0.59 g | — | 0.14 g |
| | Water | 0.22 ml | — | 0.3 ml |
| | Ethyl acetate | 6 ml | 8 ml | 16 ml |
| | Cyan Dye-Donating Compound (3) | 0.014 g | — | — |
| Aqueous layer | Lime-treated gelatin | 5.5 g | 3.1 g | 2.9 g |
| | Calcium nitrate | 0.08 g | 0.04 g | — |
| | Carboxymethyl cellulose | — | — | 0.07 g |
| | Water | 36 ml | 32 ml | 32 ml |
| Water added after emulsification | | 31 ml | 40 ml | 57 ml |
| Antiseptic (1) | | 0.002 g | 0.001 g | 0.04 g |
| $NaHSO_3$ | | — | — | 0.069 g |
| $Na_2SO_3$— | | — | 0.023 g | |

Cyan Dye-Donating Compound (3)

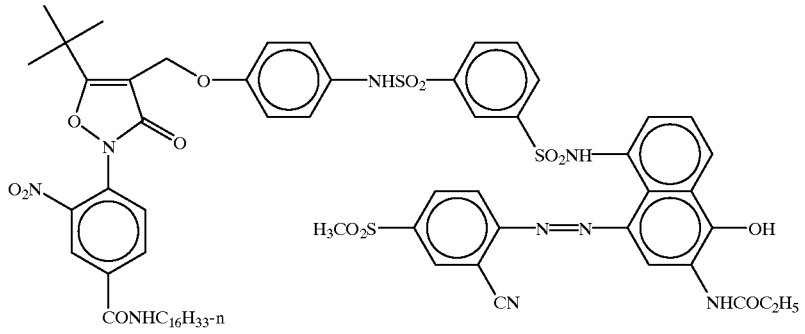

A gelatin dispersion of Reducing agent (1) was prepared according to the formulation shown in Table 44. That is, the oil phase components were dissolved under heating at about 60° C. and after aqueous phase components heated at about 60° C. were added thereto, the solutions were mixed under stirring and then dispersed in a homogenizer at 10,000 rpm for 10 minutes to obtain a homogeneous solution.

TABLE 44

| | | Dispersion Composition |
|---|---|---|
| Oil phase | Reducing Agent (1) shown above | 0.99 g |
| | High Boiling Point Solvent (2) shown above | 2.27 g |

TABLE 44-continued

| | | Dispersion Composition |
|---|---|---|
| | High Boiling Point Organic Solvent (3) shown above | 0.20 g |
| | Surface Active Agent (1) shown above | 0.46 g |
| | Surface Active Agent (7) shown above | 0.47 g |
| | Ethyl acetate | 5 ml |
| | Lime-treated gelatin | 10.0 g |
| Aqueous phase | Antiseptic (1) shown above | 0.004 g |
| | Calcium nitrate | 0.15 g |
| | Water | 45 ml |
| | Water added | 40 ml |

A dispersion of Polymer Latex (a) was prepared according to the formulation shown in Table 45. That is, while stirring the mixture solution of Polymer Latex (a) shown above, Surface Active Agent (4) shown above and water each in an amount shown in Table 45, Surface Active Agent (5) shown above was added over 10 minutes to obtain a homogeneous dispersion. The dispersion obtained was repeatedly subjected to dilution with water and concentration using an ultrafiltration module (ultrafiltration module: ACV-3050, manufactured by Asahi Chemical Industry Co., Ltd.) to reduce the salt concentration in the dispersion to 1/9.

TABLE 45

| | Dispersion Composition |
|---|---|
| Aqueous solution of Polymer Latex (a) shown above (solid contents: 13%) | 108.0 ml |
| Surface Active Agent (4) shown above | 20.0 g |
| Aqueous solution of Surface Active Agent (5) shown above (5%) | 600.0 ml |
| Water | 1232.0 ml |

A gelatin dispersion of Stabilizer (1) was prepared according to the formulation shown in Table 46. That is, the oil phase components were dissolved at room temperature, the aqueous phase components heated at about 40° C. were added thereto, the solutions were mixed under stirring and then dispersed in a homogenizer at 10,000 rpm for 10 minutes, water was added thereto, and the resulting solution was stirred to obtain a homogeneous dispersion.

TABLE 46

| | | Dispersion Composition |
|---|---|---|
| Oil phase | Stabilizer (1) shown above | 4.0 g |
| | Sodium hydroxide | 0.3 g |
| | Methanol | 62.8 g |
| | High Boiling Point Solvent (2) shown above | 0.9 g |
| Aqueous phase | Gelatin subjected to removal of calcium (Ca content: 100 ppm or less) | 10 g |
| | Antiseptic (1) shown above | 0.04 g |
| | Water | 320.5 ml |

A gelatin dispersion of zinc hydroxide was prepared according to the formulation shown in Table 47. That is, respective components were mixed, dissolved and then dispersed in a mill using glass beads having an average particle size of 0.75 mm for 30 minutes, and thereafter, the glass beads were separated and removed to obtain a homogenous dispersion (the average particle size of zinc hydroxide used was 0.25 $\mu$m).

TABLE 47

| | Dispersion Composition |
|---|---|
| Zinc hydroxide | 15.9 g |
| Carboxymethyl cellulose | 0.7 g |
| Sodium polyacrylate | 0.07 g |
| Lime-treated gelatin | 3.2 g |
| Water | 100 ml |

The preparation method of a gelatin dispersion of a matting agent added to the protective layer is described below. A solution obtained by dissolving PMMA in methylene chloride was added to gelatin together with a small amount of surface active agent and dispersed while stirring at a high speed. Subsequently, methylene chloride was removed using a vacuum solvent-removing device to obtain a homogeneous dispersion having an average particle size of 4.3 $\mu$m.

Using those prepared above, Heat-Developable Light-Sensitive Material 201 shown in Table 48 was prepared.

TABLE 48

(Construction of Light-Sensitive Material 201)

| No. of Layer | Name of Layer | Additive | Amount Coated (mg/m$^2$) |
|---|---|---|---|
| 8th Layer | First Protective Layer | Acid-treated gelatin | 418 |
| | | Colloidal silver particles | 2 |
| | | Matting agent (PMMA resin) | 16 |
| | | Compound R-1 | 17 |
| | | Compound R-5 | 122 |
| | | High Boiling Point Solvent (2) | 63 |
| | | High Boiling Point Solvent (1) | 26 |
| | | Surface Active Agent (2) | 35 |
| | | Surface Active Agent (8) | 5 |
| | | Surface Active Agent (4) | 11 |
| | | Surface Active Agent (5) | 15 |

TABLE 48-continued (Construction of Light-Sensitive Material 201)

| No. of Layer | Name of Layer | Additive | Amount Coated (mg/m$^2$) |
|---|---|---|---|
| | | Polymer Latex (a) | 18 |
| | | Calcium nitrate | 4 |
| 7th Layer | Second Protective Layer | Lime-treated gelatin | 952 |
| | | Zinc Hydroxide | 531 |
| | | Surface Active Agent (1) | 10 |
| | | Surface Active Agent (2) | 0.5 |
| | | Surface Active Agent (7) | 10 |
| | | High Boiling Point Solvent (2) | 50 |
| | | High Boiling Point Solvent (3) | 5 |
| | | Reducing Agent (1) | 2 |
| | | Calcium nitrate | 15 |
| | | Water-Soluble Polymer (5) | 4 |
| 6th Layer | Light-Sensitive Layer for 680 nm | Lime-treated gelatin | 401 |
| | | Light-Sensitive Silver Halide Emulsion (4) | 231 |
| | | Light-Sensitive Silver Halide Emulsion (5) | 27 |
| | | Magenta Dye-Donating Compound (2) | 466 |
| | | High Boiling Point Solvent (2) | 233 |
| | | Reducing Agent (1) | 6 |
| | | Antifoggant (4) | 19 |
| | | Surface Active Agent (1) | 20 |
| | | Water-Soluble Polymer (5) | 9 |
| 5th Layer | Interlayer | Lime-treated gelatin | 280 |
| | | Zinc Hydroxide | 249 |
| | | Surface Active Agent (1) | 5 |
| | | Surface Active Agent (2) | 0.2 |
| | | Surface Active Agent (7) | 0.5 |
| | | High Boiling Point Solvent (2) | 23 |
| | | High Boiling Point Organic Solvent (3) | 2 |
| | | Reducing Agent (1) | 1 |
| | | Calcium nitrate | 7 |
| | | Water-Soluble Polymer (5) | 2 |
| 4th Layer | Light-Sensitive Layer for 750 nm | Lime-treated gelatin | 365 |
| | | Light-Sensitive Silver Halide Emulsion (6) | 165 |
| | | Stabilizer (1) | 12 |
| | | Cyan Dye-Donating Compound (2) | 389 |
| | | Dye (a) | 12 |
| | | High Boiling Point Solvent (1) | 117 |
| | | High Boiling Point Solvent (2) | 389 |
| | | Reducing Agent (1) | 25 |
| | | Antifoggant (3) | 5 |
| | | Surface Active Agent (1) | 39 |
| | | Carboxymethyl cellulose | 6 |
| | | Water-Soluble Polymer (5) | 7 |
| 3th Layer | Interlayer | Lime-treated gelatin | 672 |
| | | Antifoggant (5) | 3 |
| | | Surface Active Agent (2) | 4 |
| | | Surface Active Agent (6) | 75 |
| | | Calcium nitrate | 5 |
| | | Water-Soluble Polymer (6) | 5 |
| 2rd Layer | Light-Sensitive Layer for 810 nm | Lime-treated gelatin | 596 |
| | | Light-Sensitive Silver Halide Emulsion (7) | 315 |
| | | Fine grain silver chloride | 42 |
| | | Stabilizer (1) | 9 |
| | | Yellow Dye-Donating Compound (1) | 128 |
| | | Yellow Dye-Donating Compound (2) | 307 |
| | | Cyan Dye-Donating Compound (3) | 1 |
| | | Sensitizing Dye (3) | 0.13 |
| | | Dye (a) | 45 |
| | | High-Boiling Point Solvent (1) | 64 |
| | | High-Boiling Point Solvent (2) | 154 |
| | | Surface Active Agent (1) | 45 |
| | | Reducing Agent (1) | 36 |

TABLE 48-continued (Construction of Light-Sensitive Material 201)

| No. of Layer | Name of Layer | Additive | Amount Coated (mg/m$^2$) |
|---|---|---|---|
| | | Development Accelerator (1) | 77 |
| | | Antifoggant (3) | 7 |
| | | Water-Soluble Polymer (6) | 44 |
| | | Hardening Agent (1) | 58 |
| 1st Layer | Undercoat layer | Lime-treated gelatin | 200 |
| | | Antifoggant (5) | 0.8 |
| | | Surface Active Agent (2) | 1.3 |
| | | Surface Active Agent (6) | 22 |
| | | Calcium nitrate | 1.5 |
| | | Water-Soluble Polymer (5) | 5 |
| | | Water-Soluble Polymer (6) | 1.6 |

Note: The chemical formulae of the additives described in TABLE 21 other than Water-Soluble Polymers (5) and (6) and Surface Active Agent (8) are shown above.

Surface Active Agent (8)

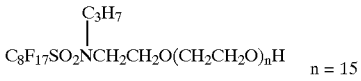

$C_8F_{17}SO_2N(C_3H_7)CH_2CH_2O(CH_2CH_2O)_nH$ n = 15

Water-Soluble Polymer (5)

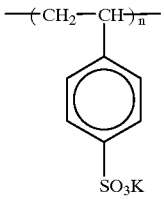

Intrinsic-viscosity number [η] = 1.6 (0.1N NaCl, 30° C.)

Molecular weight: 1,000,000

Water-Soluble Polymer (6)

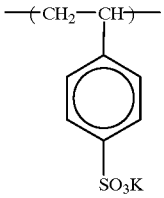

Intrinsic-viscosity number [η] = 0.8 (0.1N NaCl, 30° C.)

Molecular weight: 400,000

White sample and gray sample were prepared in the same manner except that Comparative Light-Sensitive Material 201 was used in place of light-sensitive material 101.

The yellow density of white sample was measured according to Filter Status A using a reflection densitometer X-Rite 310. The results obtained were shown in Table 49. In the Table, the higher yellow density reveals greater fogging.

Furthermore, whether or not smoke-like uneven density of image is viewed on white sample and whether or not uneven density of image is viewed on gray sample were examined. The results obtained are shown together in Table 49.

The following points can be seen from the results in Table 49.

Because Comparative Light-Sensitive Material 101 does not contain any compound represented by formula (I) or (II), the image obtained is increased in yellow fogging and has uneven density of image on gray sample.

Because Comparative Light-Sensitive Material 111 contains the compound represented by formula (I) or (II) in the second layer which is adjacent to the third layer (the light-sensitive layer for 810 nm), that is, a yellow color forming layer, the image obtained is increased in yellow fogging although it is fee of uneven density of image on gray sample.

Because Comparative Light-Sensitive Material 112 contains the compound represented by formula (I) or (II) in the eighth layer (the uppermost layer), the image obtained has smoke-like uneven density of image on white sample. Because the seventh layer is adjacent to the light-sensitive layer for 680 nm, that is, a magenta color forming layer, the image obtained is increased in magenta fogging. The image obtained has magenta color uneven density of image on glay sample.

Comparative Light-Sensitive Material 201, which corresponds to an improvement of Comparative Light-Sensitive Material 112, comprises two light-insensitive layers on the light-sensitive layer farthest from the support and the compound represented by formula (I) or (II) is contained in the uppermost layer. Because the uppermost layer is not adjacent to the light-sensitive layer for 680 nm, that is, a magenta color forming layer, the image obtained has no magenta fogging, and it is free of uneven density of image on glay sample. However, the image obtained has smoke-like uneven density of image on white sample.

From the comparison between the comparative light-sensitive materials and the light-sensitive materials of the present invention, it is seen that the image obtained using the light-sensitive materials of the present invention (a compound represented by formula (I) or (II) is contained in the first layer) is reduced in fogging and free of uneven density of image.

TABLE 49

| No. of Light-Sensitive Material | Yellow Density | Smoke-Like Uneven Density of Image on White Sample* | Uneven Density of Image on Gray Sample* | Remarks |
|---|---|---|---|---|
| 101 | 0.10 | ○ | X | Comparison |
| 102 | 0.08 | ○ | ○ | Invention |
| 103 | 0.07 | ○ | ○ | Invention |
| 104 | 0.075 | ○ | ○ | Invention |
| 105 | 0.065 | ○ | ○ | Invention |
| 106 | 0.065 | ○ | ○ | Invention |
| 107 | 0.08 | ○ | ○ | Invention |
| 108 | 0.065 | ○ | ○ | Invention |
| 109 | 0.075 | ○ | ○ | Invention |
| 110 | 0.065 | ○ | ○ | Invention |
| 111 | 0.115 | ○ | ○ | Comparison |
| 112 | 0.08 | X | X | Comparison |
| 201 | 0.08 | X | ○ | Comparison |

*When uneven density of image was viewed, the sample was rated X. When uneven density of image was not viewed, the sample was rated ○.

The heat-developable color light-sensitive material of the present invention is advantageous in that fogging at the heat development is reduced, uneven density of image is prevented from occurring on a white or halftone color sample, and the diffusion transfer image obtained has excellent discrimination.

While the invention has been described in detail and with reference to specific embodiments thereof, it will be apparent to one skilled in the art that various changes and modification can be made therein in without departing from the spirit and scope thereof.

What is claimed is:

1. A heat-developable color light-sensitive material having a multi-layer structure, comprising a support having thereon at least a light-sensitive silver halide emulsion, a hydrophilic binder and a dye-donating compound capable of releasing a diffusible dye in correspondence or counter-correspondence to the silver development, wherein at least two light-insensitive layers are provided between the support and a light-sensitive layer closest to the support and the light-insensitive layer not adjacent to the light-sensitive layer contains at least one compound represented by the following formula (I) or (II):

(I)

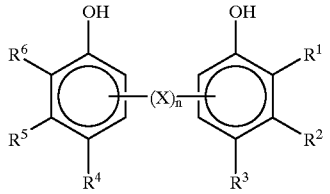

wherein $R^1$ to $R^6$ each represents hydrogen atom, a halogen atom, a hydroxyl group, a cyano group, a sulfo group, a carboxyl group, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted sulfonyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group, provided that at least one of $R^1$ and $R^3$ and at least one of $R^4$ and $R^6$ represent a hydroxyl group and that $R^1$ and $R^2$, $R^2$ and $R^3$, $R^4$ and $R^5$, or $R^5$ and $R^6$ may be combined with each other to form a ring, X represents a divalent linking group, and n represents 1 or 0;

(II)

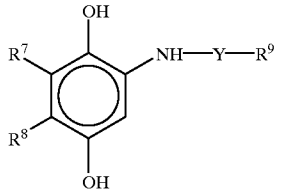

wherein $R^7$ and $R^8$ each represents hydrogen atom, a halogen atom, a substituted or unsubstituted alkyl group, a substituted or unsubstituted aryl group, a substituted or unsubstituted heterocyclic group, a substituted or unsubstituted carbamoyl group, a substituted or unsubstituted sulfamoyl group, a substituted or unsubstituted acyl group, a substituted or unsubstituted arylcarbonyl group, a substituted or unsubstituted alkoxy group, a substituted or unsubstituted aryloxy group, a substituted or unsubstituted alkylthio group, a substituted or unsubstituted arylthio group, a substituted or unsubstituted alkoxycarbonyl group, a substituted or unsubstituted aryloxycarbonyl group, a substituted or unsubstituted amino group or a substituted or unsubstituted acyloxy group, provided that $R^7$ and $R^8$ may combine with each other to form a ring, Y represents —CO— or —$SO_2$—, and $R^9$ represents a substituted or unsubstituted alkyl group, a substituted or unsubstituted aryl group, a substituted or unsubstituted heterocyclic group, a substituted or unsubstituted alkoxy group, a substituted or unsubstituted aryloxy group or a substituted or unsubstituted amino group.

2. The heat-developable color light-sensitive material as claimed in claim 1, which is scan-exposed at an exposure time of $1\times10^{-5}$ seconds or lower per one picture element.

3. The heat-developable color light-sensitive material as claimed in claim 1 or 2, wherein at least one light-sensitive layer has a sensitivity maximum wavelength in the infrared wavelength region of 750 nm or more.

4. The heat-developable color light-sensitive material as claimed in claim 1, wherein the compound represented by the formula (I) or (II) is ballasted so as to be inhibited from moving between the coating layers both at the coating time and at the developing time.

5. The heat-developable color light-sensitive material as claimed in claim 4, wherein the compound has high organic property where the I/O value is 1.5 or less.

6. The heat-developable color light-sensitive material as claimed in claim 1, wherein the dye-donating compound is represented by the following formula (LI):

$$(\text{Dye-Y'})_n\text{—Z} \qquad \text{(LI)}$$

wherein Dye represents a dye group or a dye group or dye precursor group temporarily shifted to a short wavelength, Y' represents a mere bond or a linking group, Z represents a group having a property of causing a difference in the diffusibility of the compound represented by $(\text{Dye-Y'})_n$—Z in correspondence or counter-correspondence to the light-sensitive silver salt having an imagewise latent image or releasing the Dye and causing a difference in the diffusibility between the released Dye and the $(\text{Dye-Y'})_n$—Z, n represents an integer of 1 or 2, and when n is 2, two Dye-Y' moieties may be the same or different.

* * * * *